US010995601B2

(12) United States Patent
Guertin et al.

(10) Patent No.: US 10,995,601 B2
(45) Date of Patent: May 4, 2021

(54) HORIZONTAL DIRECTIONAL DRILL WITH ASSISTED MODE AND RELATED METHODS

(71) Applicant: THE TORO COMPANY, Bloomington, MN (US)

(72) Inventors: Richard John Guertin, Mounds View, MN (US); Lee Evan von Lehe, Falcon Heights, MN (US); Adam John Lorang, Lake Elmo, MN (US); Stephen Joseph Sartori, Bloomington, MN (US)

(73) Assignee: THE TORO COMPANY, Bloomington, MN (US)

( * ) Notice: Subject to any disclaimer, the term of this patent is extended or adjusted under 35 U.S.C. 154(b) by 442 days.

(21) Appl. No.: 15/884,799

(22) Filed: Jan. 31, 2018

(65) Prior Publication Data

US 2018/0363443 A1 Dec. 20, 2018

Related U.S. Application Data

(60) Provisional application No. 62/521,606, filed on Jun. 19, 2017.

(51) Int. Cl.
*E21B 19/15* (2006.01)
*E21B 44/00* (2006.01)
(Continued)

(52) U.S. Cl.
CPC ..... *E21B 44/00* (2013.01); *E21B 7/046* (2013.01); *E21B 19/15* (2013.01); *E21B 7/02* (2013.01); *E21B 19/06* (2013.01)

(58) Field of Classification Search
CPC ..... E21B 19/06; E21B 19/15; E21B 44/00; E21B 7/02; E21B 7/046
See application file for complete search history.

(56) References Cited

U.S. PATENT DOCUMENTS 4,042,123 A * 8/1977 Sheldon ..... E21B 19/20 414/22.71
4,422,794 A 12/1983 Deken
(Continued)

OTHER PUBLICATIONS

Toro 2024 Directional Drill; Model No. 23800—Serial No. 313000501 and Up, Model No. 23800A—Serial No. 315000001 and Up, Model No. 23800C—Serial No. 315000001 and Up, Model No. 23800TE—Serial No. 315000001 and Up, Model No. 23800W—Serial No. 315000001 and Up, Software Guide. Form No. 3413-630 Rev A, The Toro Company, Copyright 2017; 20 pages.
(Continued)

*Primary Examiner* — Daniel P Stephenson
(74) *Attorney, Agent, or Firm* — Mueting Raasch Group

(57) ABSTRACT

A horizontal directional drill and method relate to a control system adapted to operate a pipe transport apparatus to move a drill rod between a rod box and a connection area. The control system commands the pipe transport apparatus to perform a plurality of actions wherein at least one of the actions comprises two or more of the plurality of physical operations. The control system includes an operator input device configured to generate a command in response to an operator input. The control system may require persistent engagement of the operator input device to complete each action. The pipe transport apparatus pauses upon completing each of the plurality of actions until the command is again provided from the operator input device.

19 Claims, 20 Drawing Sheets

(51) Int. Cl.

| | |
|---|---|
| ***E21B 7/04*** | (2006.01) |
| ***E21B 19/06*** | (2006.01) |
| ***E21B 7/02*** | (2006.01) |

(56) References Cited

U.S. PATENT DOCUMENTS

| | | | |
|---|---|---|---|
| 4,945,999 | A | 8/1990 | Malzahn |
| 4,953,638 | A | 9/1990 | Dunn |
| 5,070,948 | A | 12/1991 | Malzahn et al. |
| 5,148,880 | A | 9/1992 | Lee et al. |
| 5,242,026 | A | 9/1993 | Deken et al. |
| 5,556,253 | A | 9/1996 | Rozendaal et al. |
| 5,607,280 | A | 3/1997 | Rozendaal |
| 5,944,121 | A | 8/1999 | Bischel et al. |
| 6,085,852 | A | 7/2000 | Sparks et al. |
| 6,179,065 | B1 | 1/2001 | Payne et al. |
| 6,332,502 | B1 | 12/2001 | Mills et al. |
| 6,357,537 | B1 | 3/2002 | Runquist et al. |
| 6,360,830 | B1 | 3/2002 | Price |
| 6,374,928 | B1 | 4/2002 | Teller et al. |
| 6,408,954 | B1 | 6/2002 | Price et al. |
| 6,474,931 | B1 | 11/2002 | Austin et al. |
| 6,474,932 | B1 | 11/2002 | Rush |
| 6,533,046 | B2 | 3/2003 | Mills et al. |
| 6,543,551 | B1 | 4/2003 | Sparks et al. |
| 6,550,547 | B1 | 4/2003 | Payne et al. |
| 6,814,164 | B2 | 11/2004 | Mills et al. |
| 6,845,825 | B2 | 1/2005 | Bischel et al. |
| 6,910,541 | B2 | 6/2005 | Kelpe |
| 7,011,166 | B2 | 3/2006 | Koch et al. |
| 7,018,164 | B2 | 3/2006 | Anthis et al. |
| 7,240,742 | B2 | 7/2007 | Sewell et al. |
| 7,467,670 | B2 | 12/2008 | Hartke et al. |
| 7,562,724 | B2 | 7/2009 | Allred et al. |
| 7,600,584 | B2 | 10/2009 | Sewell et al. |
| 7,694,751 | B2 | 4/2010 | Hartke |
| 8,136,612 | B2 | 3/2012 | Carlson et al. |
| 8,151,906 | B2 | 4/2012 | Salins et al. |
| 8,235,142 | B2 | 8/2012 | Carlson et al. |
| 2002/0153169 | A1 | 10/2002 | Sewell |
| 2002/0157870 | A1* | 10/2002 | Bischel ..... E21B 19/20 175/52 |
| 2018/0363443 | A1* | 12/2018 | Guertin ..... E21B 44/00 |

OTHER PUBLICATIONS

DitchWitch, "JT20 Operator's Manual: Drill First Pipe," excerpt, p. 99. Available at least as early as Jan. 27, 2017; 1 page.

* cited by examiner

HORIZONTAL DIRECTIONAL DRILL WITH ASSISTED MODE AND RELATED METHODS

CROSS-REFERENCE TO RELATED APPLICATIONS

The present application claims the benefit of U.S. Provisional Patent Application Ser. No. 62/521,606, filed Jun. 19, 2017, entitled HORIZONTAL DIRECTIONAL DRILL WITH ASSISTED MODE AND RELATED METHODS, which is incorporated entirely herein by reference.

FIELD

Embodiments described herein are directed to horizontal directional drills and, more particularly, to horizontal directional drills and methods providing an assisted mode for drill rod placement.

BACKGROUND

Horizontal directional drills are known for drilling horizontal boreholes beneath a ground surface, e.g., under a roadway or other obstruction (sometimes referred to as "trenchless" digging). Typically, a horizontal directional drill includes a rod box adapted to hold a plurality of drill rods. These drill rods may be transported, one rod at a time, from the rod box to a connection area of the drill where the rod may be attached to other drill rods to form a drill string. The drill string may be attached to a gear box that may rotate and axially advance the drill string to form the horizontal borehole. Once the drill string is advanced, the most-recently added drill rod may be detached from the gear box, the gear box axially retracted, and another drill rod introduced into the connection area where it is then also connected to the drill string in the connection area.

In addition to adding drill rod to the string, horizontal directional drills are also able to retract the drill string (e.g., "backreaming"), sequentially remove drill rods from the drill string, and transport the individual drill rods back to the rod box.

In many horizontal directional drills transport of a drill rod from the rod box to the connection area ("pushing") and from the connection area back to the rod box ("pulling") is under complete manual control of the drill operator(s). These pushing and pulling processes generally require several distinct operations/manipulations of the various components of the drill system. As one can appreciate, such manual operation may be tedious and time consuming for the drill operator. For example, an operator may need to repeatedly command the drill to perform the various pushing/pulling operations and, sometimes, react to interruptions. The repetitive nature of such operation, and the potential for unexpected interruptions, can present challenges to drill operation, particularly over extended periods of time.

SUMMARY

In one embodiment, a horizontal directional drill is provided that includes a frame defining a connection area. The drill also includes a drive system attached to the frame and adapted to rotate and axially advance a drill string comprised of two or more drill rods. The drill includes a rod box attached to the frame and adapted to hold a plurality of drill rods. The drill also includes a pipe transport apparatus operable to move a drill rod from the rod box to the connection area by executing a plurality of physical operations. The drill includes a control system adapted to operate the pipe transport apparatus. The control system commands the pipe transport apparatus to perform a plurality of actions wherein at least one of the actions comprises two or more of the plurality of physical operations. The control system includes an electronic controller operatively connected to the pipe transport apparatus. The control system also includes an operator input device operatively connected to the controller and configured to generate a command to the controller in response to an operator input. The control system is adapted to execute each of the plurality of actions in response to receipt of the command and a detected state of the pipe transport apparatus. The pipe transport apparatus pauses upon completing each of the plurality of actions until the command is again provided from the operator input device to the controller.

In another embodiment, a horizontal directional drill is provided that includes a rod box adapted to hold a plurality of drill rods. The drill also includes a frame attached to the rod box and defining a connection area to attach one of the plurality of drill rods to a drill string. The drill includes a pipe transport apparatus coupled to the frame and adapted to perform a plurality of physical operations to move a drill rod between the rod box and the connection area. The drill also includes an electronic controller operatively coupled to the pipe transport apparatus and adapted to operate the pipe transport apparatus. The drill includes an operator input device operatively coupled to the controller and adapted to receive an operator input. The controller is further adapted to execute a plurality of actions each comprising one or more physical operations of the plurality of physical operations. The controller is further adapted to command the pipe transport apparatus to perform each of the physical operations encompassed by the current action in response to the operator input device receiving the operator input. The controller is further adapted to pause operation of the pipe transport apparatus upon completion of the current action before performing a subsequent action of the plurality of actions.

In yet another embodiment, a method of operating a horizontal directional drill is provided that includes receiving input at an operator input device for a pipe transport apparatus adapted to perform a plurality of physical operations in order to move a drill rod between a rod box and a connection area. The method further includes commanding the pipe transport apparatus to perform two or more of the plurality of physical operations in response to persistent engagement of the operator input device. The method includes pausing operation of the pipe transport apparatus upon completing the two or more physical operations until the operator input is disengaged and reengaged.

The above summary is not intended to describe each embodiment or every implementation. Rather, a more complete understanding of various illustrative embodiments will become apparent and appreciated by reference to the following Detailed Description of Exemplary Embodiments in view of the accompanying figures of the drawing.

BRIEF DESCRIPTION OF THE DRAWINGS

Exemplary embodiments will be further described referring to the figures of the drawing, wherein:

FIGS. 5A-J are enlarged perspective views of the horizontal directional drill of FIG. 1A showing different states of the horizontal directional drill related to the loading of a drill rod (push sequence), wherein: FIG. 5A shows a cam in a home position, FIG. 5B shows the cam rotated to a selected row, FIG. 5C shows a lowered elevator, FIG. 5D shows the cam rotated out, FIG. 5E shows a closed pipe gripper, FIG. 5F shows a raised elevator, FIG. 5G shows an extended arm, FIG. 5H shows an open pipe gripper, FIG. 5I shows a retracted arm, and FIG. 5J shows the cam returned to the home position.

FIGS. 8A-E illustrate exemplary graphics that may be displayed to the operator during transport of a drill rod from the rod box to the connection area (push sequence) and may highlight particular action graphics, wherein: FIG. 8A highlights a first action graphic showing rotating the cam from the home position to the selected row and lowering the elevator, FIG. 8B highlights a second action graphic showing rotating the cam out to the connection area, closing the pipe gripper, and raising the elevator, FIG. 8C highlights a third action graphic showing extending the arm, FIG. 8D highlights a fourth action graphic showing opening the pipe gripper that may be related to an operator also performing manual makeup and lubrication operations, FIG. 8E highlights a fifth action graphic showing retracting the arm and rotating the cam back to the home position.

FIGS. 9A-E illustrate exemplary graphics that may be displayed to the operator during transport of a drill rod from the connection area to the rod box (pull sequence) and may highlight particular action graphics, wherein: FIG. 9A highlights a first action graphic showing rotating the cam from the home position out to the connection area, extending the arm, and lowering the elevator, FIG. 9B highlights a second action graphic showing closing the pipe gripper that may be related to an operator also performing manual breakout operations, FIG. 9C highlights a third action graphic showing the arms retracting, FIG. 9D highlights a fourth action graphic showing the cam rotating from the connection area to the selected row and opening the pipe gripper, FIG. 9E highlights a fifth action graphic showing raising the elevator and rotating the cam back to the home position.

FIGS. 11A-B are enlarged perspective views of the horizontal directional drill of FIG. 10 showing some of the different states of the horizontal directional drill related to the loading of a drill rod (push sequence), wherein: FIG. 11A shows a closed pipe gripper and FIG. 11B shows a second cam (shown as an arm) rotated out to position a drill rod in the connection area.

Figure 1A:
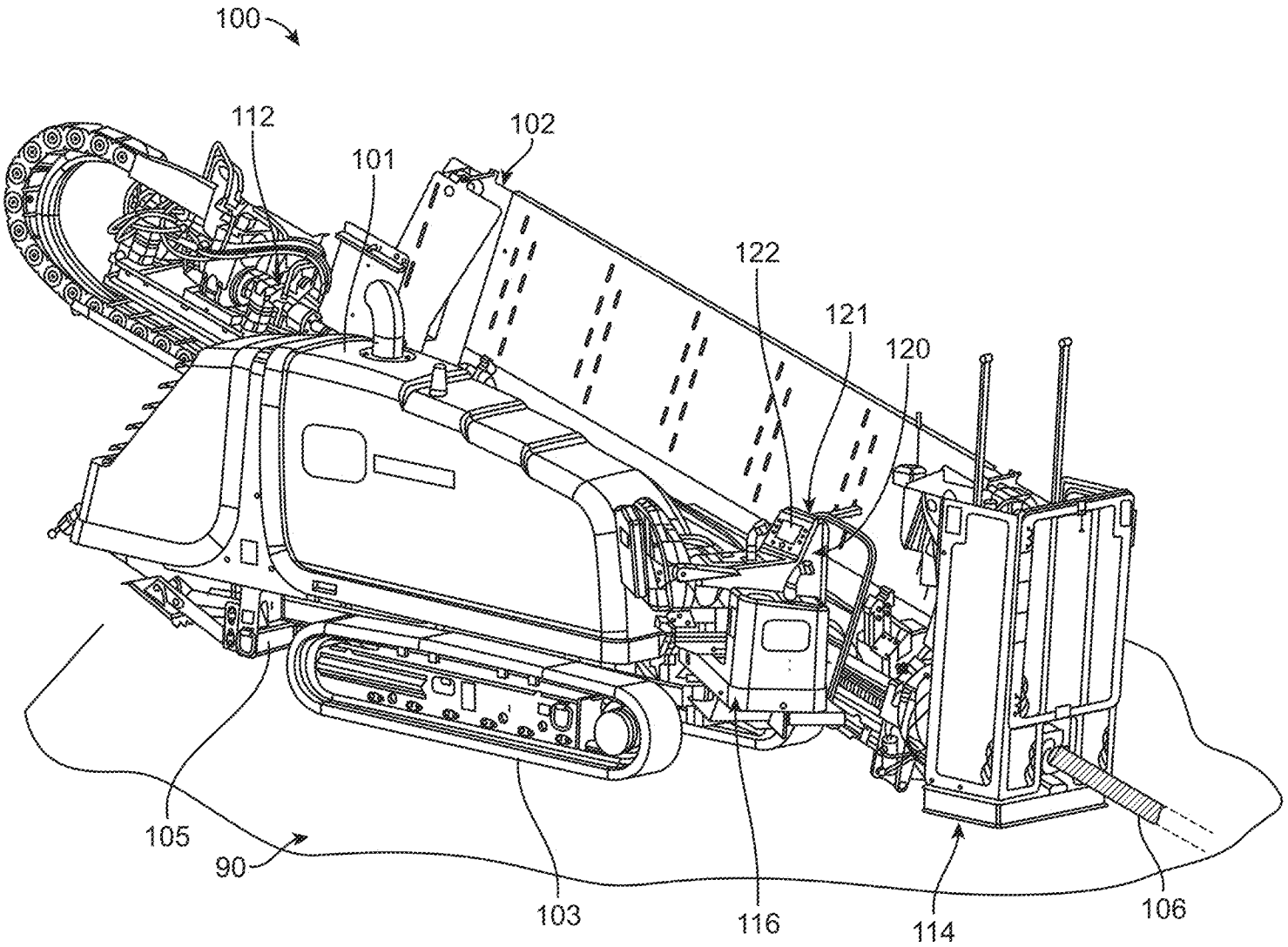
FIG. 1A is a perspective view of a horizontal directional drill incorporating an assisted mode in accordance with one embodiment of the present disclosure, the drill including a connection area and a rod box.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all the views to better illustrate aspects of the depicted embodiments, or where inclusion of such structure/components is not necessary to an understanding of the various exemplary embodiments described. The lack of illustration/description of such structure/components in any figure is, however, not to be interpreted as limiting the various embodiments in any way.

DETAILED DESCRIPTION OF EXEMPLARY EMBODIMENTS

Embodiments of the present disclosure are directed to a horizontal directional drill and associated methods that provide an assisted mode to aid an operator with transporting drill rods between a rod box and a connection area of the horizontal directional drill (the latter of which may be referred to herein merely as a "drill"). The horizontal directional drill with the assisted mode can assist with performing a plurality of physical operations necessary to transport a drill rod between the rod box and the connection area in response to receiving sequential operator inputs. For example, in some embodiments, the horizontal directional drill includes a pipe transport apparatus and a control system. The control system receives each operator input and commands the pipe transport apparatus to perform a subset of the plurality of physical operations. That is to say, for each operator input, only some of the plurality of physical operations to move a rod between the rod box and the connection area (or vice-versa) are performed (i.e., the horizontal directional drill pauses between pauses after each subset of the one or more physical operations. The control system may include an input/output device that presents the subsets of physical operations to the operator, e.g., on a screen that highlights the current subset being executed. The operator may need to sequentially interact with the drill controls during the pushing/pulling sequences or processes for pipe transport.

The exemplary assisted mode of the control system may allow an operator to transport drill rods between the rod box and connection area with less manual input than a conventional unassisted drill, which may increase productivity and reduce tediousness associated with more manual rod transport. Moreover, pausing operation between various groups of physical operations may facilitate robust control over the drill rod transport processes. Moreover, a drill providing an assisted mode like those described herein may maintain operator involvement in the transport process as opposed to systems that may fully automate rod transport. Further, the presentation of groups of physical operations may ensure the operator is informed as to which group of physical operations is currently being performed, as well as provide a visual prompt of any previous and subsequent actions in the transport process.

Referring to the figures of the drawing, wherein like reference numerals designate like parts and assemblies throughout the several views, FIG. 1 illustrates a horizontal directional drill 100 in accordance with embodiments of the present disclosure. Again, while so described and illustrated, such a construction is not limiting as aspects of the depicted/described embodiments may find application to other types of drills (e.g., non-horizontal drills), as well as to other types of machines or powered equipment.

As used herein, "have", "having", "include", "including", "comprise", "comprising" or the like are used in their open-ended sense, and generally mean "including, but not limited to", unless the content clearly dictates otherwise.

Moreover, relative terms such as "lateral," "axial," "distal," "proximal," "forward," "reverse," "below," "above," and the like may be used herein. These terms are used only to simplify the description, however, and not to limit the interpretation of any described embodiment.

The terms "coupled," "attached," "connected," and the like refer to elements being attached to each other either directly (in direct contact with each other) or indirectly (having one or more elements between and attaching the two elements).

Reference to "one embodiment," "an embodiment," "certain embodiments," or "some embodiments," etc., means that any feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the features, configurations, compositions, or characteristics may be combined in any suitable manner in one or more embodiments.

The term "and/or" means one or all of the listed elements or a combination of any two or more of the listed elements (e.g., casting and/or treating an alloy means casting, treating, or both casting and treating the alloy).

The phrases "at least one of," "comprises at least one of," and "one or more of" followed by a list refers to any one of the items in the list and any combination of two or more items in the list.

Figure 1B:
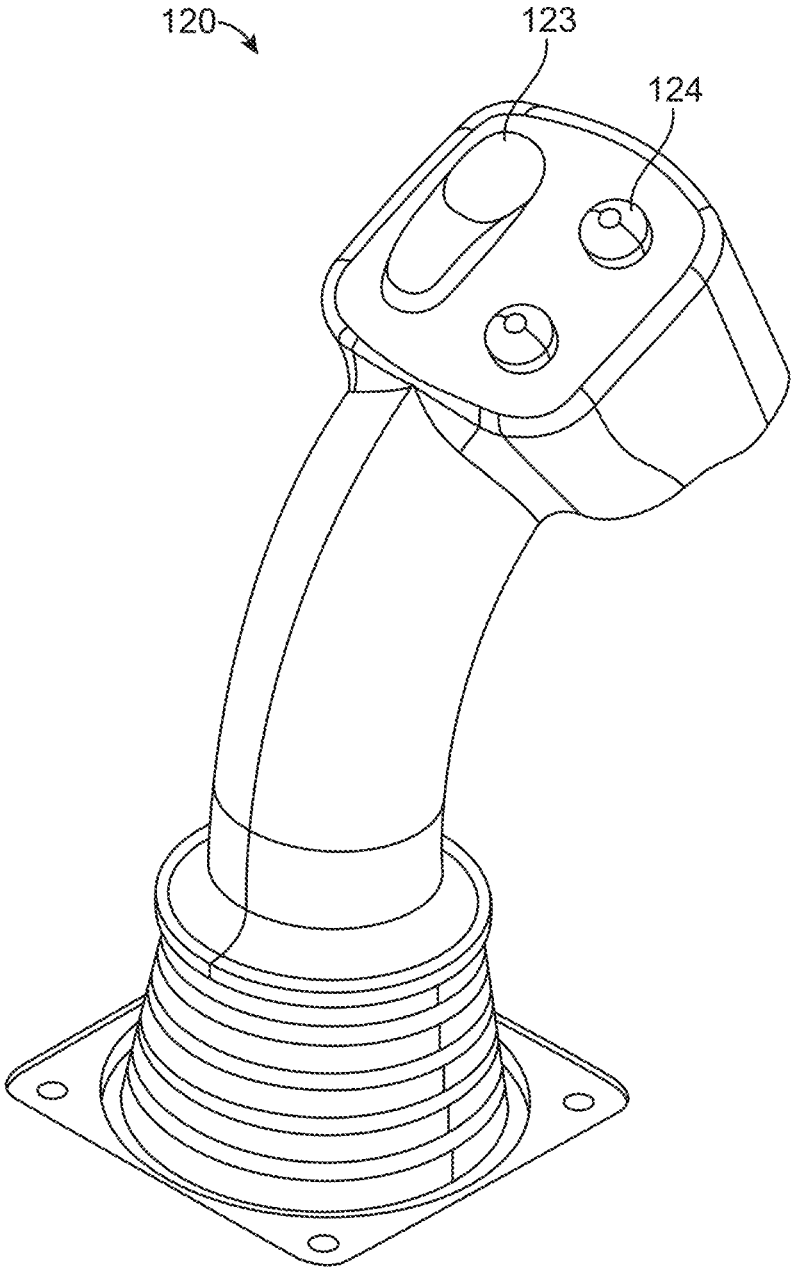
FIG. 1B is a perspective view of an operator input device.
Figure 1C:
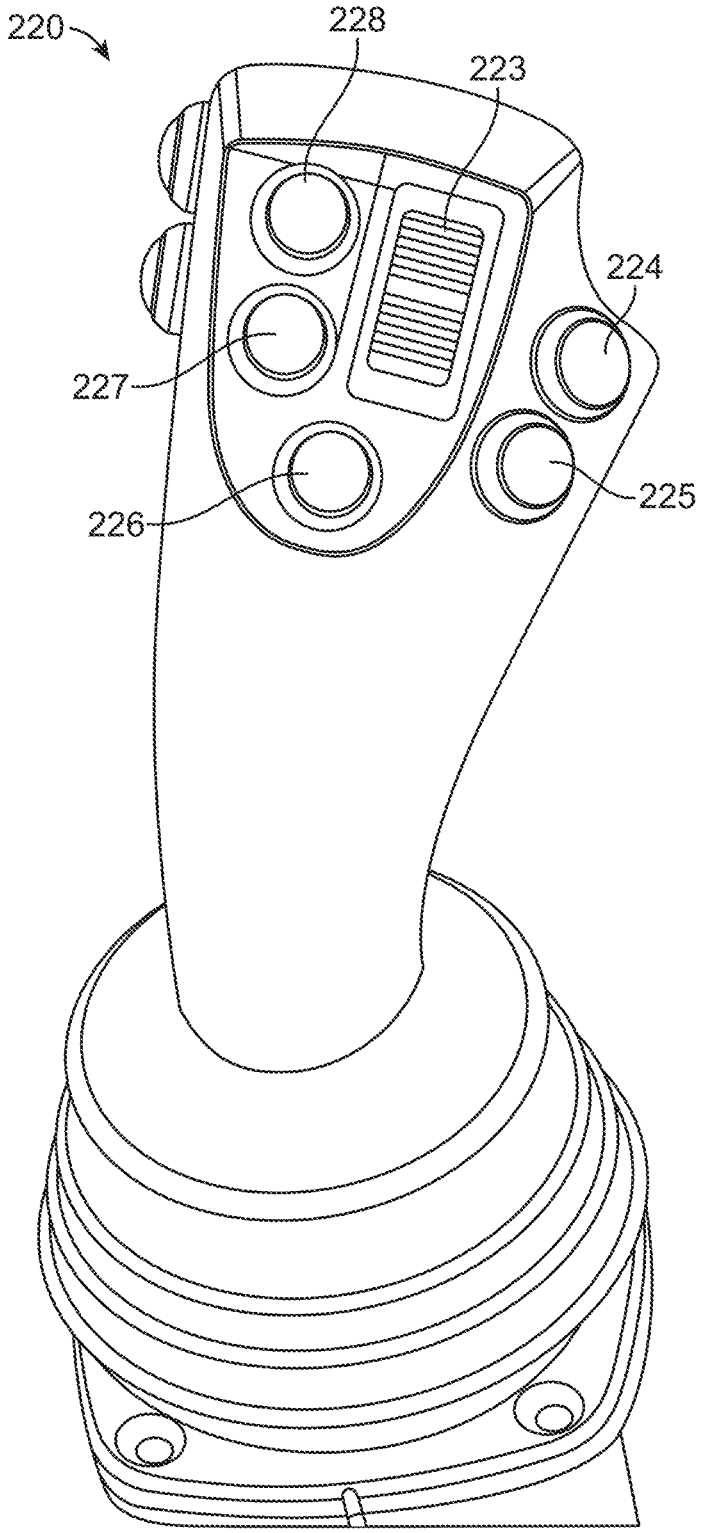
FIG. 1C is a perspective view of an operator input device in accordance with another embodiment of the present disclosure.
Figure 2:
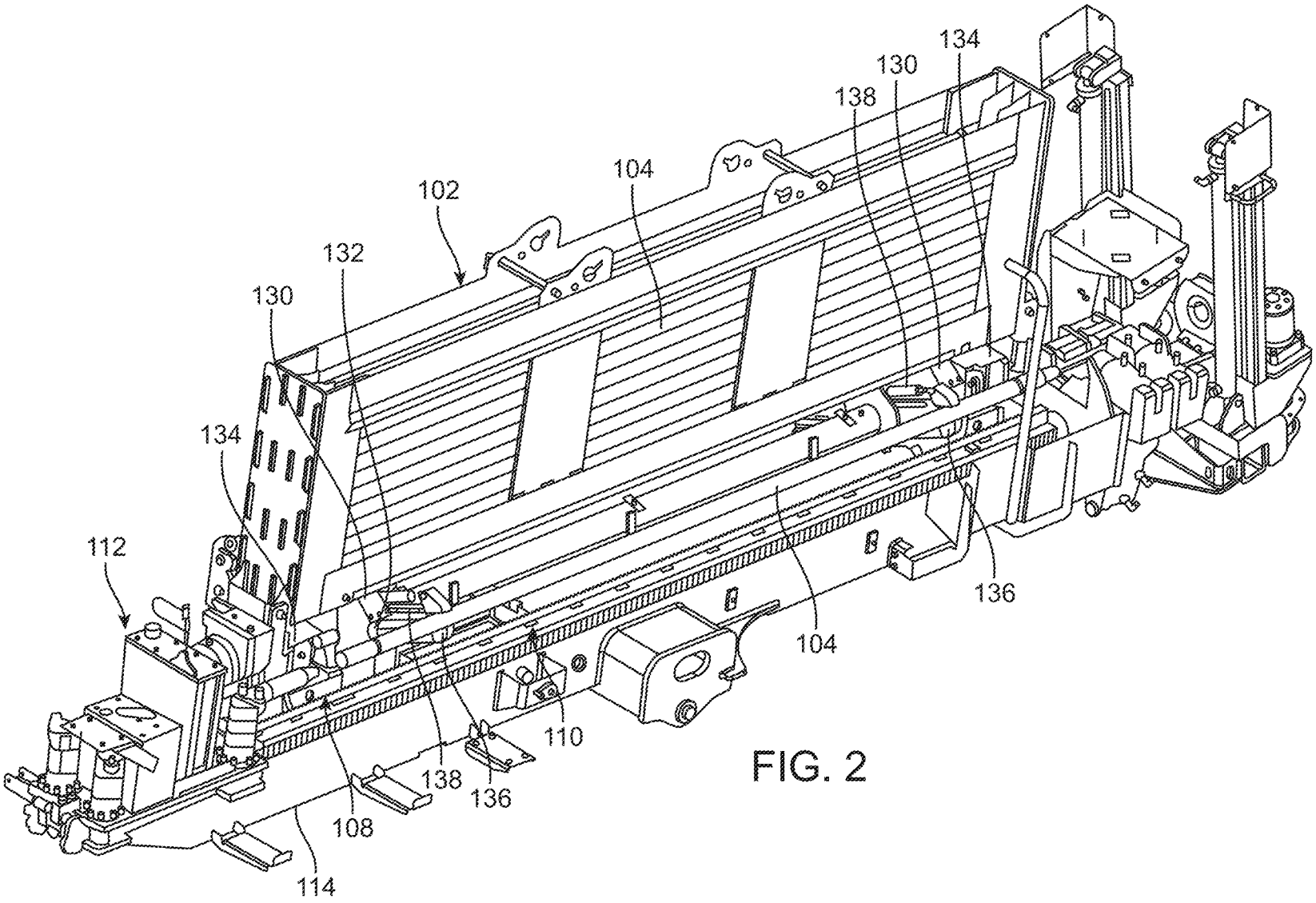
FIG. 2 is a partial perspective view of the horizontal directional drill of FIG. 1A showing the connection area.

FIGS. 1A, 1B, and 2 show an exemplary horizontal directional drill 100 (referred to herein also merely as "drill"). FIG. 1A shows the drill 100 resting upon a ground surface ("ground" 90). FIG. 1B shows an exemplary operator input device 120 with a rocker switch 123. FIG. 2 shows an enlarged perspective view of the drill 100, particularly showing a connection area 110. FIG. 1C shows an alternative operator input device 220 that could be used in place of the operator input device 120.

The horizontal directional drill 100 may be mobile and capable of self-propelled movement across the ground 90 to arrive and leave a worksite. The drill 100 may include, for example, endless tracks 103 (only right track shown, but left side of drill may include a similar track). Other ground contact members (e.g., wheels, footings) may also be used to support the drill 100 upon the ground 90.

The drill 100 may include a chassis 105 supporting an adjacent drill frame 114 above the ground 90. The frame 114 (perhaps as best shown in FIG. 2) may define the connection area 110, the purpose of which is described in more detail below. Other components of the 100 may also be supported by, or coupled to, the frame 114.

The chassis may also support a prime mover 101, e.g., internal combustion engine, that powers the various systems of the drill. For example, the prime mover 101 may power (directly or indirectly) the tracks 103 to propel the drill 100 over the ground 90. Moreover, the prime mover may power a hydraulic pump (not shown) that provides power for drill advancement and other operations, as well as for selectively extending ground stabilizing legs.

A rod box 102 may be attached to the frame 114. The rod box 102 can hold a plurality of drill rods 104. The drill rods 104 may be cylindrical and generally elongate in shape between two ends. The drill rod 104 may be solid or hollow (e.g., a pipe). As used herein, the terms "rod" and "pipe" may be used interchangeably to mean either a solid or hollow rod. The one or more drill rods 104 may be connected to one another (e.g., end to end) to form a drill string 106 that may be advanced to form a horizontal bore hole beneath the ground 90. Each drill rod 104 may define a proximal end closer to a drive system 112 and an opposite, distal end closer to the existing drill string 106 or the ground 90. One drill rod 104 at a time can be added to the existing drill string 106 by connecting the distal end of the drill rod to the proximal end of the drill string. The connection area 110 may be used to attach drill rods 104 to one another (and to the drive system 112) to form the drill string 106.

The drill rods 104 within the rod box 102 may be arranged into rows along a bottom side of the rod box. For example, the rod box 102 may have three rows of drill rods 104 available to be selected for attachment to the drill string 106. Each row of drill rods 104 in the rod box 102 may include a plurality of drill rods in a stacked configuration. The bottom or lowest drill rod 104 in each row, or stack, may be accessed for transport to the connection area 110.

In some embodiments, each elongate drill rod 104 includes a male threaded portion and a female threaded portion disposed on opposite ends of the drill rod. In some embodiments, the drill rods 104 are screwed together one at a time to form the drill string 106. The drill string 106 may be advanced into the horizontal borehole in the ground 90 adjacent to the drill 100 (e.g., see FIG. 1).

The drill 100 may further include a pipe transport apparatus 108 adapted to perform, or to execute, a plurality of physical operations to move a drill rod 104 between the rod box 102 and the connection area 110. The physical operations may be performed in order. However, one or more of the physical operations may be performed concurrently so that one operation need not be completed before another begins. The pipe transport apparatus 108, which may be coupled to and supported by the frame 114, may be disposed adjacent to the rod box 102 and the connection area 110 to facilitate moving or transporting the drill rods 104 from the rod box to the connection area 110, or vice versa. The connection area 110 may be disposed laterally between the pipe transport apparatus 108 and the chassis 105. In some embodiments, the pipe transport apparatus 108 is positioned below the rod box 102. Once the pipe transport apparatus 108 moves a drill rod 104 into the connection area 110, the drill rod may be attached to and added to the drill string 106, which may be configured to accept a connection to additional drill rods.

Any suitable type of pipe transport apparatus 108 may be utilized as the pipe transport apparatus 108 move a drill rod 104 to and from the connection area 110, including pipe transport apparatuses that have different components than those described herein. In one example, in the illustrated embodiment, the pipe transport apparatus 108 may include one or more cam assemblies. Each cam assembly may include a cam 130 disposed generally below the rod box 102 (see also FIGS. 5A-5J) that defines a cam pocket 132 (see also FIG. 5B) adapted to receive a drill rod 104 as further described below, a pipe gripper 136 (see also FIG. 5E) to selectively hold the drill rod, and an arm 138 (see also FIG. 5G) attached to and supporting the pipe gripper 136. In the illustrated embodiments (e.g., as shown in FIG. 2), the pipe transport apparatus 108 includes two cam assemblies to support opposite ends of each drill rod as the latter is moved. However, other embodiments may include one, or three or more, cam assemblies without departing from the scope of this disclosure.

Like the cam assemblies, the drill 100 may also include two or more elevators 134 (see FIG. 2) to support drill rods 104 in the rod box 102, such that one elevator is positioned at or near each end of the drill rods. Each elevator 134 may be disposed adjacent to the bottom of the rod box 102. When raised, an upper surface of each elevator 134 may support each row of drill rods 104 by contacting the lowermost drill rod of each row adjacent to the bottom side of the rod box 102. When the elevators 134 are lowered, all the drill rods 104 in the rod box 102 may be lowered until the drill rods are supported by the cam 130 instead of the elevator. One drill rod 104 associated with the operator-selected row may enter the cam pocket 132. The elevators 134 may raise the drill rods 104, for example, to add a drill rod to the rod box 102 or, after a drill rod has been moved to the connection area 110, to place the remaining drill rods back into the rod box.

With the illustrated cam system, each cam 130 may rotate as further described below to align with any one of the rows of drill rods 104 in the rod box 102. The cams 130 may also rotate in an opposite direction toward the connection area 110 until reaching a connection area position. An actuator (e.g., rotary or linear actuator or motor) may rotate the cam under control of the operator and/or control system.

In the illustrated embodiment, the cam pocket 132 may be formed in each of the cams 130. Each cam 130 may be rotated to align its cam pocket 132 with an operator-selected row of the rod box 102. The elevators 134 may then be lowered to place the lowest drill rod 104 in the selected row into the cam pocket 132. The drill rod 104 may move with the cam pockets 132 as the cams 130 are rotated. To ensure retention of the remaining drill rods 104 in the rod box 102, the elevators 134 may rise just as the cams 130 rotate past the rod box edge.

In addition to allowing a drill rod 104 to exit the rod box 102, the elevators 134 may also be raised to place the drill rod 104 back into a pre-selected row of the rod box 102. When the pipe transport apparatus 108 is not in use, the cams 130 may be rotated to a home position, which may be the same as the connection area position, a selected row of the rod box position, or a different position (e.g., a position in between the connection area and the rod box positions).

A pipe gripper 136 may be disposed associated with each of the cams 130 (e.g., with each cam pocket 132). After a drill rod 104 has been placed into the cam pockets 132, the pipe grippers 136 may be closed to hold the drill rod in place. The pipe grippers 136 may be opened to release the drill rod 104, for example, after the drill rod is positioned in the connection area 110 or after the cams 130 rotate back toward a selected row of the rod box and before the elevators 134 are raised. When closed, the pipe grippers 136 may maintain control of the drill rod 104 throughout various operations, particularly as the cams 130 rotate out to or from the connection area 110 and as the arms 138 extend to or retract from the connection area. Any suitable mechanism may be used to secure and release the drill rod 104. In some embodiments, the pipe grippers 136 include opposing jaws that mechanically open and close (e.g., under hydraulic or electric power) to clamp the drill rod 104. The pipe grippers 136 may still allow the drive system 112 to rotate the drill rod 104 in place (e.g., spin the drill rod) to attach the drill rod 104 to the drill string 106.

Each arm 138 may be disposed adjacent to its respective cam pocket 132. The arms 138 may be able to extend and retract the pipe grippers 136 during operation. The arms 138 may be extended, for example, to place the drill rod 104 held by the pipe grippers 136 into the connection area 110 from the cam pocket 132. Each arm 138 may be retracted, for example, to place a drill rod 104 held by the pipe grippers 136 into the cam pocket 132 from the connection area 110. Any suitable mechanism may be used to extend and retract the pipe grippers 136 (e.g., pneumatic, hydraulic, or electric pistons).

The drill 100 may further include a drive system 112 adapted to selectively rotate and axially advance the drill string 106, which may contain one or more connected drill rods 104. The exemplary drive system 112 may also be attached to the frame 114 adjacent to the connection area 110. The drive system 112 may connect drill rods 104 to an existing drill string 106 by threading the distal end of the drill rod to the proximal end of the drill string, and threading the proximal end of the drill rod to the drive system. Threading may be assisted by the operator. The drive system 112 may then axially advance the drill string 106 into or out of the ground 90. The drive system 112 can then be disconnected or unthreaded from the drill string 106. The drive system 112 may then retract from the drill string 106 leaving space in the connection area 110 to receive a new drill rod 104 from the rod box 102. In some embodiments, the drive system 112 can be used to push the drill string and/or pull the drill string in an axial direction along a length of a drill rod 104 or the drill string. The axial direction may be a low-angle relative to the plane of the ground 90. In addition to axial drill string movement, the drive system 112 may also rotate the drill string as needed to form and/or backream the borehole.

Various components of the drill 100, such as the rod box 102 and the pipe transport apparatus 108, described herein may be similar to commercially available drills, such as the TORO® 2024 Directional Drill.

The drill 100 may further include a control system 116, which may be coupled to and supported by the chassis 105 and may include components coupled to the drill frame 114, adapted to operate or command at least some aspects of the pipe transport apparatus 108. In the illustrated embodiments, the control system 116 includes an electronic controller 118 (see also FIG. 3) and an operator input/output system 121 (see FIG. 3). In some embodiments, an operator may be seated to interface or interact with the operator input/output system 121 (see also FIG. 3). The operator input/output system 121 may include the operator input device 120 (see also FIG. 3) and an operator output device 122 (see also FIG.

3). The operator input device 120 may include any components capable of receiving input from the operator (e.g., a display screen, a touchscreen, a rocker switch, a joystick button switch, or other human-machine interface). In the illustrated embodiment, the operator input device 120 includes a rocker switch 123 and two joystick button switches 124. Similarly, the operator output device 122 may include any components capable of providing information to the operator (e.g., a display screen, a speaker, a vibration motor, or another human-perceptible indicator). The electronic controller 118 may be operatively connected to the pipe transport apparatus 108 to provide one or more commands to perform or execute a plurality of actions.

Each action may correspond to, or encompass, one or more physical operations that the pipe transport apparatus 108 undertakes in moving a drill rod 104 between the rod box 102 and the connection area 110. The one or more physical operations, which may be a pre-defined sequence, can be executed by the control system 116. In some embodiments, at least one of the actions includes two or more physical operations. One or more activities that are non-transport activities (e.g., not performed by engaging the rocker switch), or otherwise not part of the push and pull sequences for pipe transport, may be required before the subsequent, or next, action can begin.

As used herein, "sequence" means that one or more events (e.g., operations, actions, or activities) may be ordered such that certain events happen before, during, or after other events. However, one event need not finish before another event begins. For example, one or more operations may begin before another operation finishes. One or more consecutive operations in a sequence may even begin at the same time.

The electronic controller 118 may be operatively connected to the operator input device 120 to receive one or more operator inputs therefrom. The electronic controller 118 may provide or generate commands to execute one or more physical operations in response to receiving one or more operator inputs. In some embodiments, the control system 116 commands and controls all the physical operations encompassed by one action in response to receiving one corresponding operator input. For example, the electronic controller 116 may command at least first and second physical operations of the plurality of physical operations in response to receiving one operator input. In some embodiments, the execution of the one or more physical operations proceed to completion if the operator input device 120 remains persistently engaged by the operator.

The electronic controller 118 may keep track of the current action being executed while the drill is operating. The electronic controller 118 may command the one or more physical operations further in response to a detected state of the pipe transport apparatus 108. The detected state of the pipe transport apparatus 108 may correspond to the current action or subsequent action of the plurality of actions. The detected state may also include other information that may be used to determine the response of the electronic controller 118 when an operator input from the operator input device 120 is detected.

As further described herein, the control system 116 may pause between executing the various actions. That is to say, the control system 116 may pause after completing execution of an action despite persistent engagement of the operator input device 120 by the operator. For example, a first operator input may correspond to executing a first action, and upon completion of the first action, the pipe transport apparatus 108 may be paused by the controller system 116 before a second action begins, e.g., until a second operator input is provided. The second operator input may be of the same type as, or different than, the first operator input. For example, in some embodiments, the control system 116 may pause until the operator input device 120 is disengaged and then reengaged by the operator.

In some embodiments, the operator input device 120 includes a rocker switch disposed on a joystick. The rocker switch may be manipulated between a neutral position, a forward position (e.g., a forward operator input), and optionally a reverse position (e.g., a reverse operator input). The electronic controller 118 may generate a plurality of commands, which may be in a sequence, when the operator presses and holds the rocker switch in the forward position. In some embodiments, persistent engagement by the operator involves holding the rocker switch in the forward position.

While the operator holds the rocker switch in the forward position to complete an action, the pipe transport apparatus 108 may execute at least first and second physical operations encompassed by the action. The pipe transport apparatus 108 may then pause after completing the physical operations encompassed by the action even if the operator continues to engage the rocker switch in the forward position. In some embodiments, disengagement by the operator includes releasing the rocker switch from the forward position.

When the rocker switch is released before completing a physical operation or action, the pipe transport apparatus 108 may cease executing the incomplete physical operation or action until the rocker switch is reengaged. In some embodiments, moving the rocker switch to the reverse position before completing a physical operation or action causes the pipe transport apparatus 108 to stop and then reverse the physical operation or action (e.g., backup the action(s) to undo one or more physical operations).

The operator input device 120 may be configured to receive a toggle operator input to switch the pipe transport apparatus 108 between the push/pull sequences. In some embodiments, the operator input device 120 includes one or more button switches adjacent to a display screen, which may display graphics or images corresponding to the adjacent button switches that, when pressed, registers the toggle operator input. The same display screen may be, or form part of, the operator output device 122. Toggling may change the set of graphics displayed on the display screen of the operator output device 122.

The controller 118 may be operatively connected to the operator output device 122 to provide one or more status indications. In some embodiments, the operator output device 122 is a screen or monitor that is operable to display one or more graphics corresponding to each of the plurality of actions for moving a drill rod 104 between the rod box 102 and the connection area 110. The operator output device 122 may display graphics corresponding to the pipe transport sequences, such as moving the drill rod 104 from the rod box 102 to the connection area 110 (e.g., the push sequence) or, rather, moving the drill rod from the connection area to the rod box (e.g., the pull sequence). The operator output device 122 may concurrently display all graphics corresponding to the push sequence, the pull sequence, or both.

The operator output device 122 may update the indication after completing an action. In some embodiments, the operator output device 122 updates the graphics after an action is completed and the operator input device 120 is disengaged or released. For example, one or more graphics may be updated after each action is completed and the rocker switch is released from the forward position.

In some embodiments, the operator output device 122 may display graphics corresponding to all the pipe transport actions for the push sequence, the pull sequence, or both. In some embodiments, only graphics corresponding to either the push sequence or the pull sequence are displayed, as selected by the operator. The operator output device 122 may display all the actions provided by the pipe transport 108, with the current action being highlighted, e.g., emphasizing the graphic representing the action or its border with a larger size, color, or both.

The functions of the electronic controller 118 may be performed by hardware and/or as computer instructions on a non-transient computer readable storage medium. The electronic controller 118 may include one or more computing devices having memory, processing, and communication hardware. The electronic controller 118 may include a processor, which may include any one or more of a central processing unit (CPU), computer, microprocessor, a controller, a digital signal processor (DSP), an application specific integrated circuit (ASIC), a field-programmable gate array (FPGA), and/or equivalent discrete or integrated logic circuitry capable of directing data coming into or out of the control system 116. In some examples, the processor may include multiple components, such as any combination of one or more microprocessors, one or more controllers, one or more DSPs, one or more ASICs, and/or one or more FPGAs, as well as other discrete or integrated logic circuitry. The functions attributed to the electronic controller 118, or processor thereof, described herein may be embodied as software, firmware, hardware, or any combination thereof. While described herein as a processor-based system, an alternative electronic controller could utilize other components such as relays and timers to achieve the desired results, either alone or in combination with a microprocessor-based system.

In one or more embodiments, the exemplary systems, methods, and interfaces (e.g., the control system 116 and related components herein) may be implemented using one or more computer programs using a computing apparatus such as a processor and memory. Program code and/or logic described herein may be applied to input data to perform functionality described herein and generate desired output information. The output information may be applied as an input to one or more other devices and/or methods as described herein or as would be applied in a known fashion. In view of the above, it will be readily apparent that the electronic controller 118 functionalities as described herein may be implemented in any manner known to one skilled in the art.

FIG. 1C shows an exemplary operator input device 220 including a rotary switch 223 and joystick button switches 224, 225, 226, 227, 228, which may be used as an alternative to operator input device 120. For convenience, one embodiment of the operator input device 220 is shown configured for the left hand of the operator. The operator engages the joystick button switch 224 to provide a reverse operator input and engages the joystick button switch 225 to provide a forward operator input. The rotary switch 223 and other joystick button switches 226, 227, 228 may provide other functionality of the drill, which may or may not be related to the assisted mode. For example, the joystick button switch 226 is associated with toggling the pipe gripper 136 between open and closed positions. The joystick button switches 227, 228 are associated with lowering or raising the elevators 134, respectively. The rotary switch 223 is associated with rotating the cams 130 in or out, which can override the assisted mode in some cases.

Figure 3:
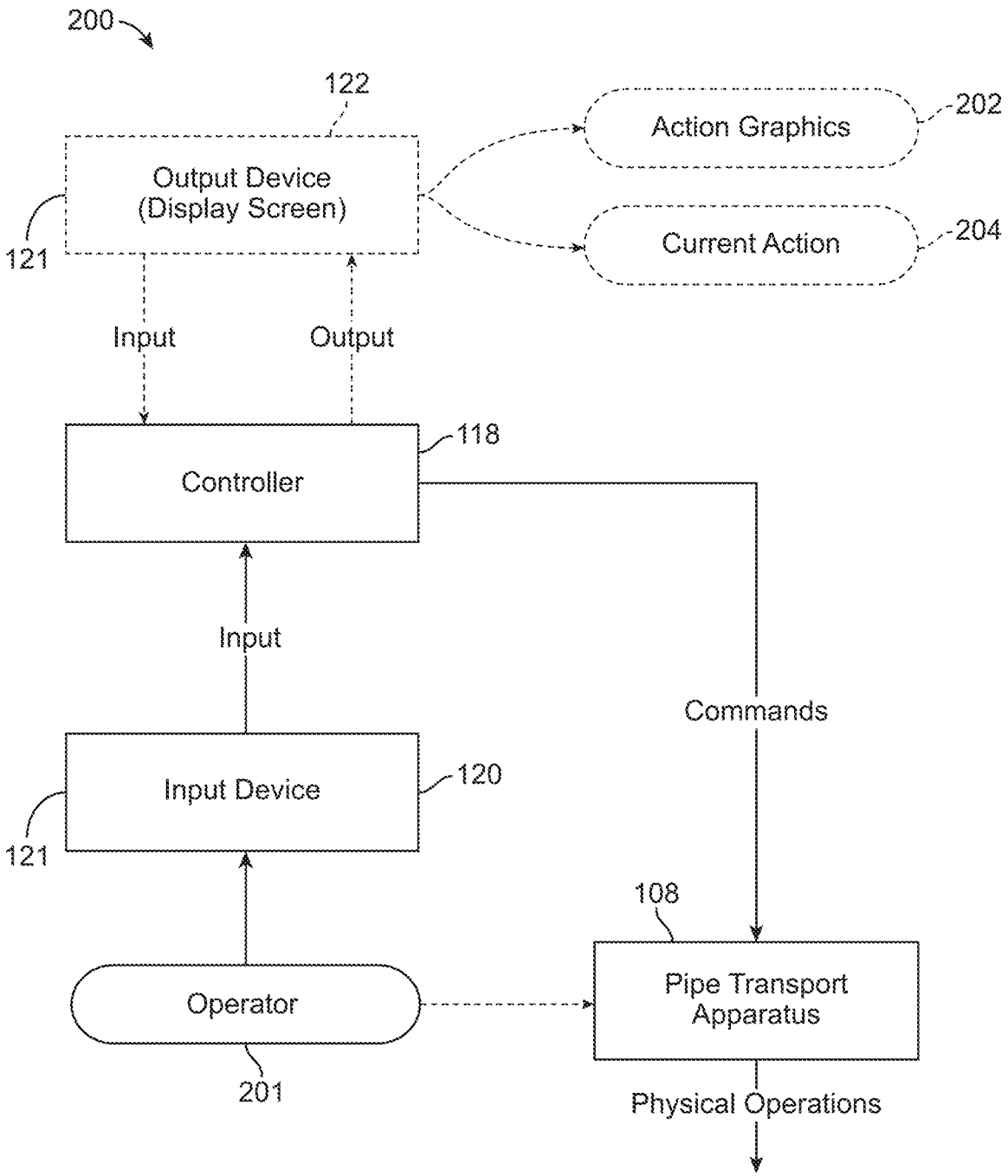
FIG. 3 is a diagrammatic view illustrating various components of the horizontal directional drill of FIG. 1A.

FIG. 3 shows an exemplary diagrammatic representation of an operative connection layout 200 of various components of a horizontal directional drill, such as horizontal directional drill 100 (FIG. 1). The operator 201 engages the operator input device 120, which may include one or more of a rocker switch or joystick button switch. The operator 201 may also execute other activities in the push/pull sequence, e.g., engaging the joystick to thread the drill rod to the drill string. The engagement may be detected as an operator input by the electronic controller 118 of the control system. In response to the detected operator input, the electronic controller 118 may provide one or more commands to the pipe transport apparatus 108 to execute one or more physical operations to transport the drill rod. The operator 201 may toggle the controller 118 between a push sequence (introducing drill rods to the connection area) and a pull sequence (removing drill rods from the connection area) using the operator input device 120. The operator output device may display action graphics 202 that represent the actions required to transport drill rod. The operator output device may display a current action indicator 204 that represents the current action, for example, by highlighting the same on the display screen. The operator output device 122 may include a display screen, which may correspond to adjacent button switches used as a component of the operator input device 120 in an input/output system 121.

Figure 4:
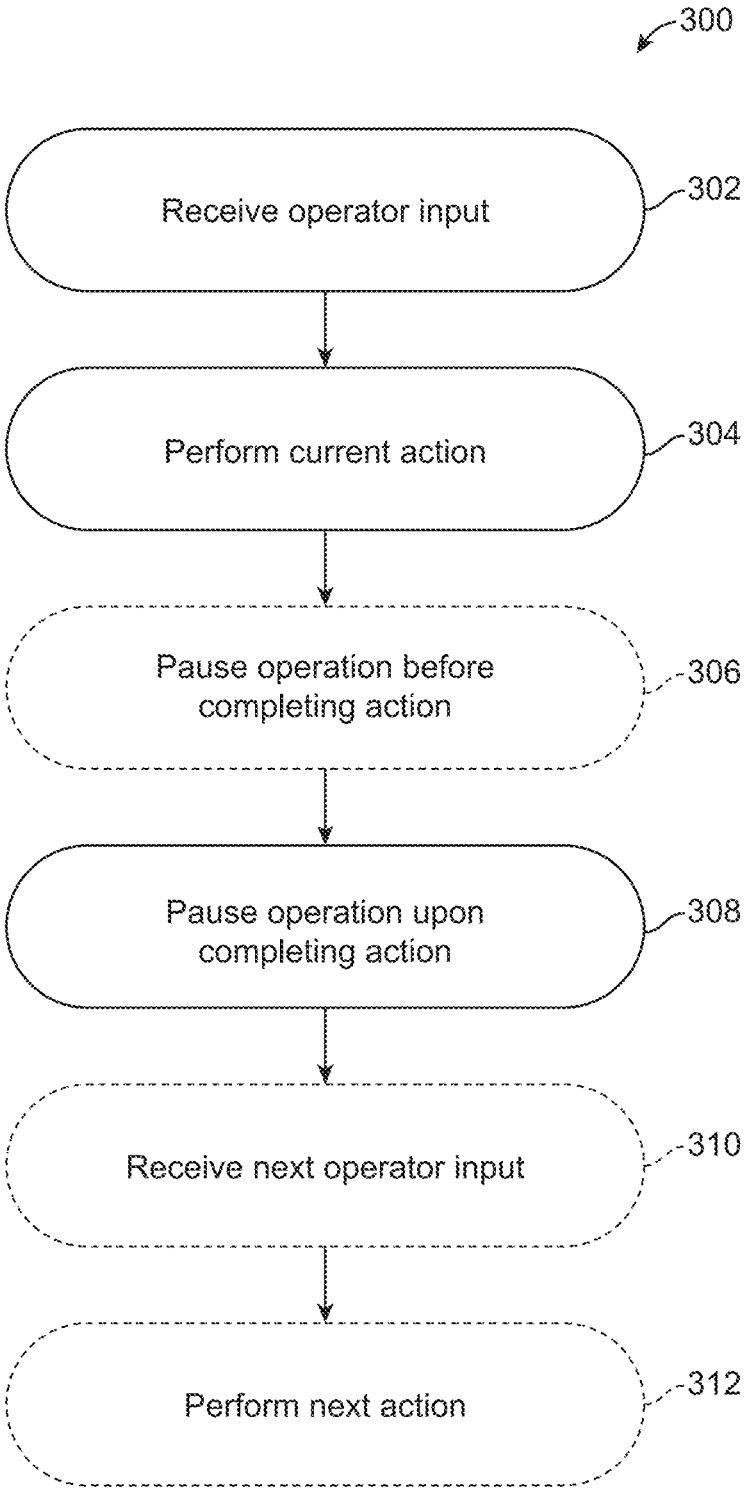
FIG. 4 is a flowchart showing a method of controlling the horizontal directional drill of FIG. 1A in accordance with one embodiment of the present disclosure.

FIG. 4 is a flowchart showing an example method 300 of controlling a horizontal directional drill, such as the horizontal directional drill 100 (FIG. 1). In process 302, operator input (e.g., moving rocker switch to forward position) is received. In process 304, a current action (e.g., one or more physical operations of the pipe transport apparatus) is performed in response to the received operator input. In optional process 306, the operation of the pipe transport apparatus may be paused before completion of the present action, for example, by the operator disengaging an operator input device (rocker switch). In process 308, the operation of the pipe transport apparatus is paused automatically after completing the current action. Once again, the action may include one, two, or more physical operations of the pipe transport apparatus. The method 300 may end after process 308 or may continue, for example, if the completed action was not the last action in the push/pull sequence. In optional process 310, a next operator input may be received, which may correspond to a next action (encompassing the next physical operations needed to transport drill rods). If the next operator input is received, in optional process 312, the next action may be performed in response to receiving the next operator input. The example method 300 may be used to load or unload a drill rod, for example, as applied to a push sequence or a pull sequence.

Figure 5A:
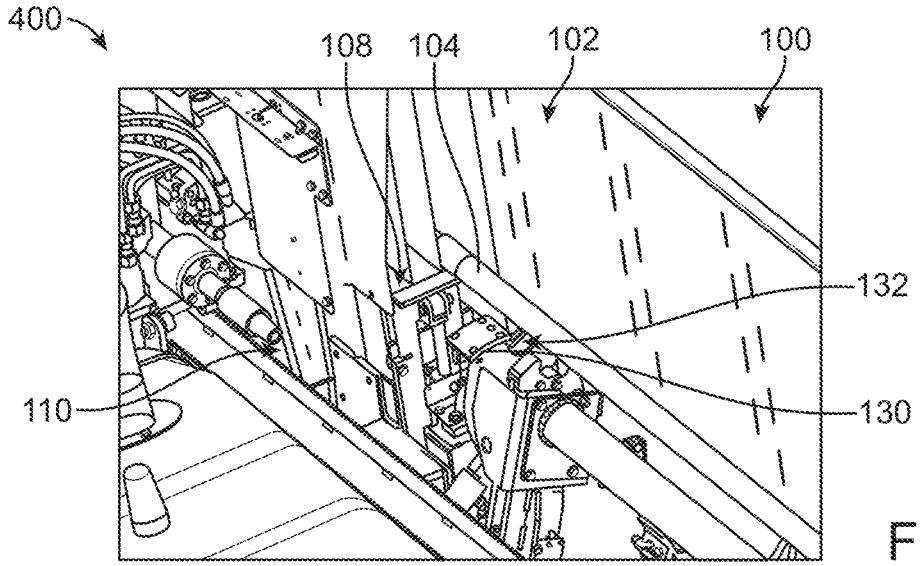
Figure 5B:
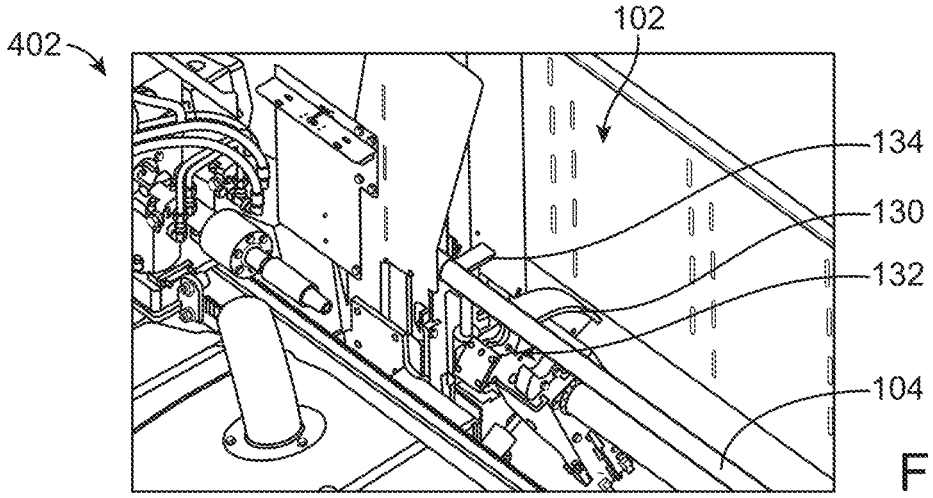
Figure 5C:
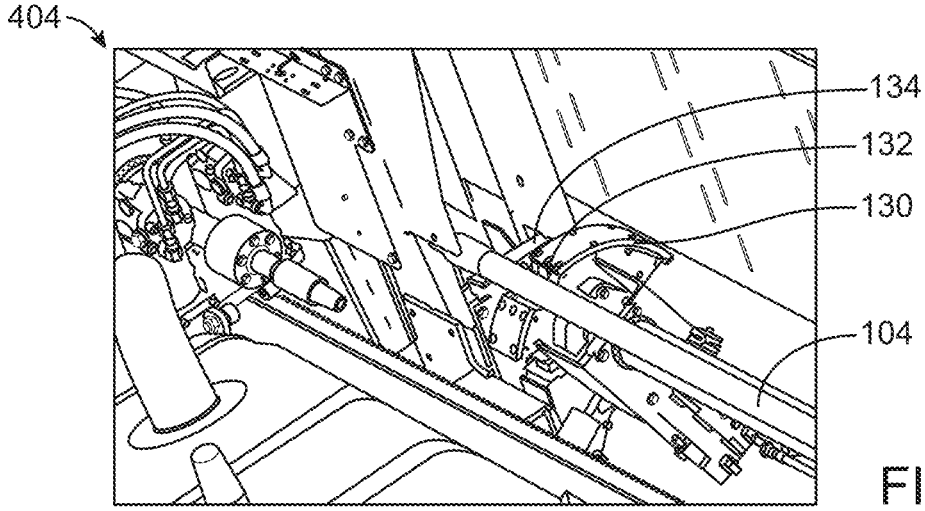
Figure 5D:
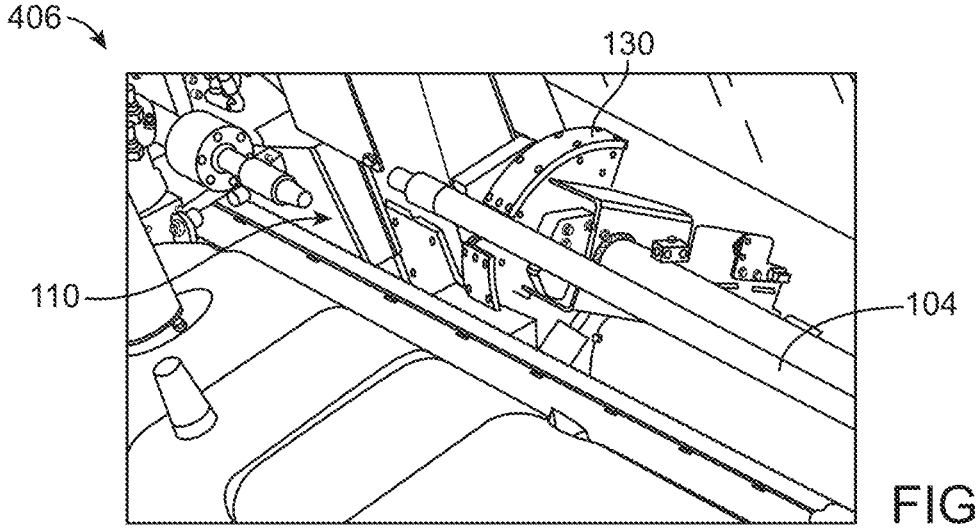
Figure 5E:
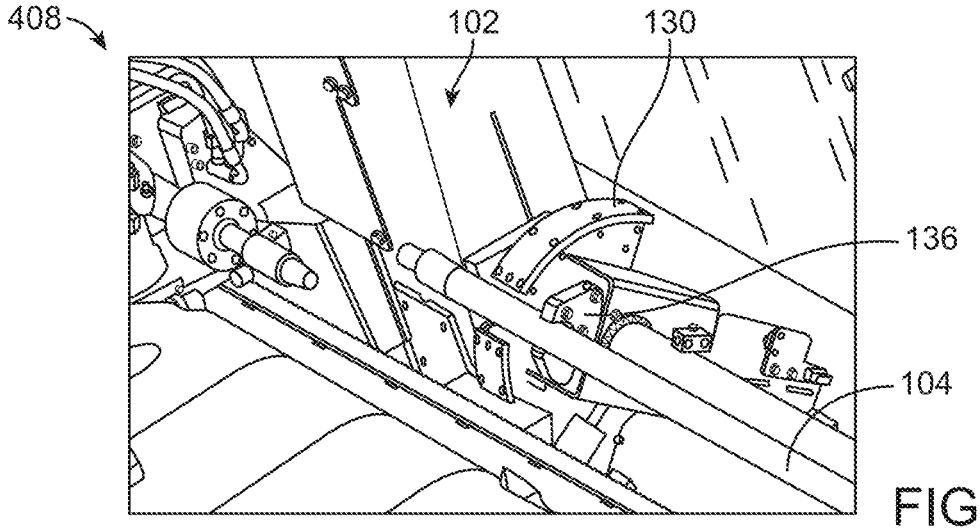
Figure 6:
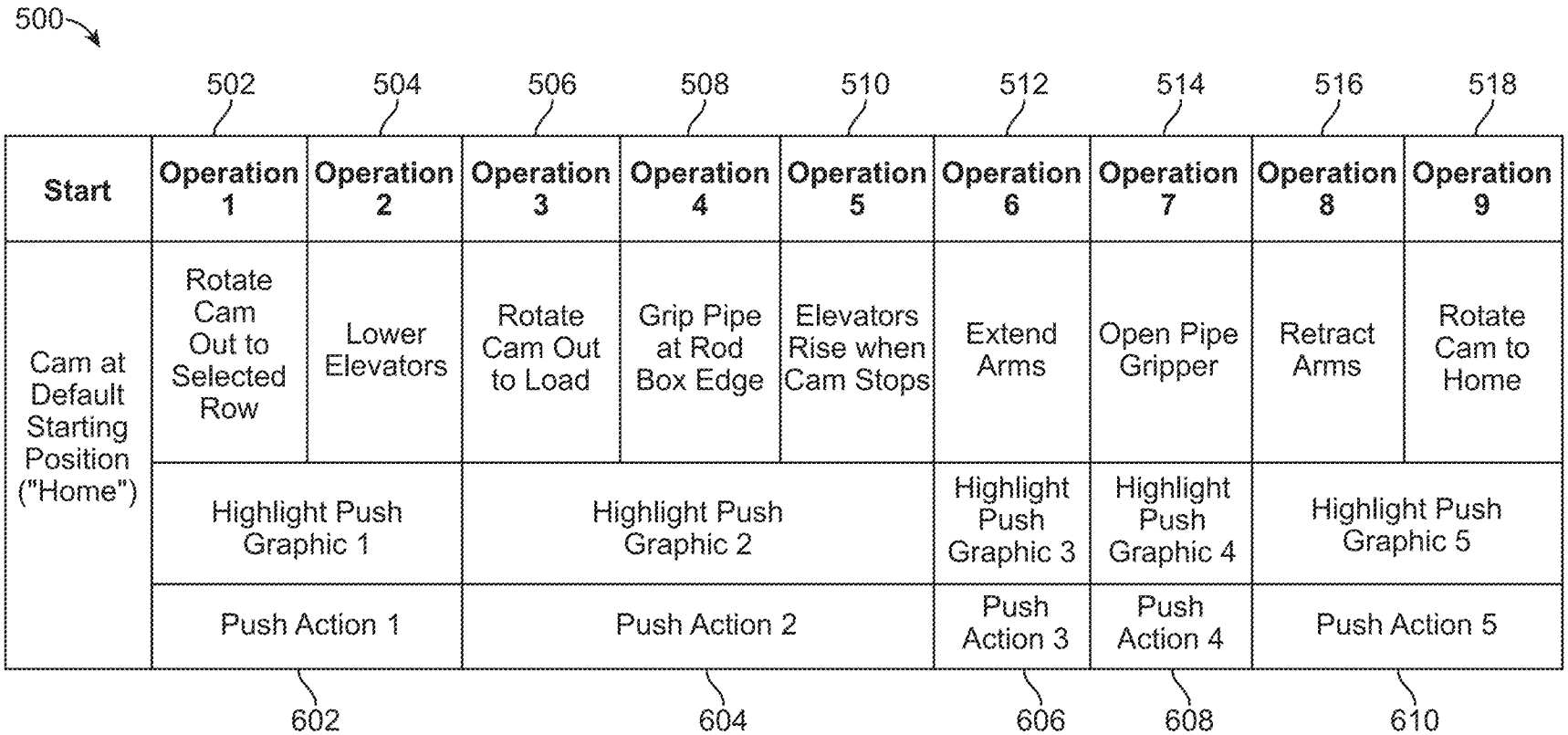
FIG. 6 is a table showing various processes used to transport a drill rod from the rod box to the connection area (push sequence) in accordance with one embodiment of the disclosure.
Figure 7:
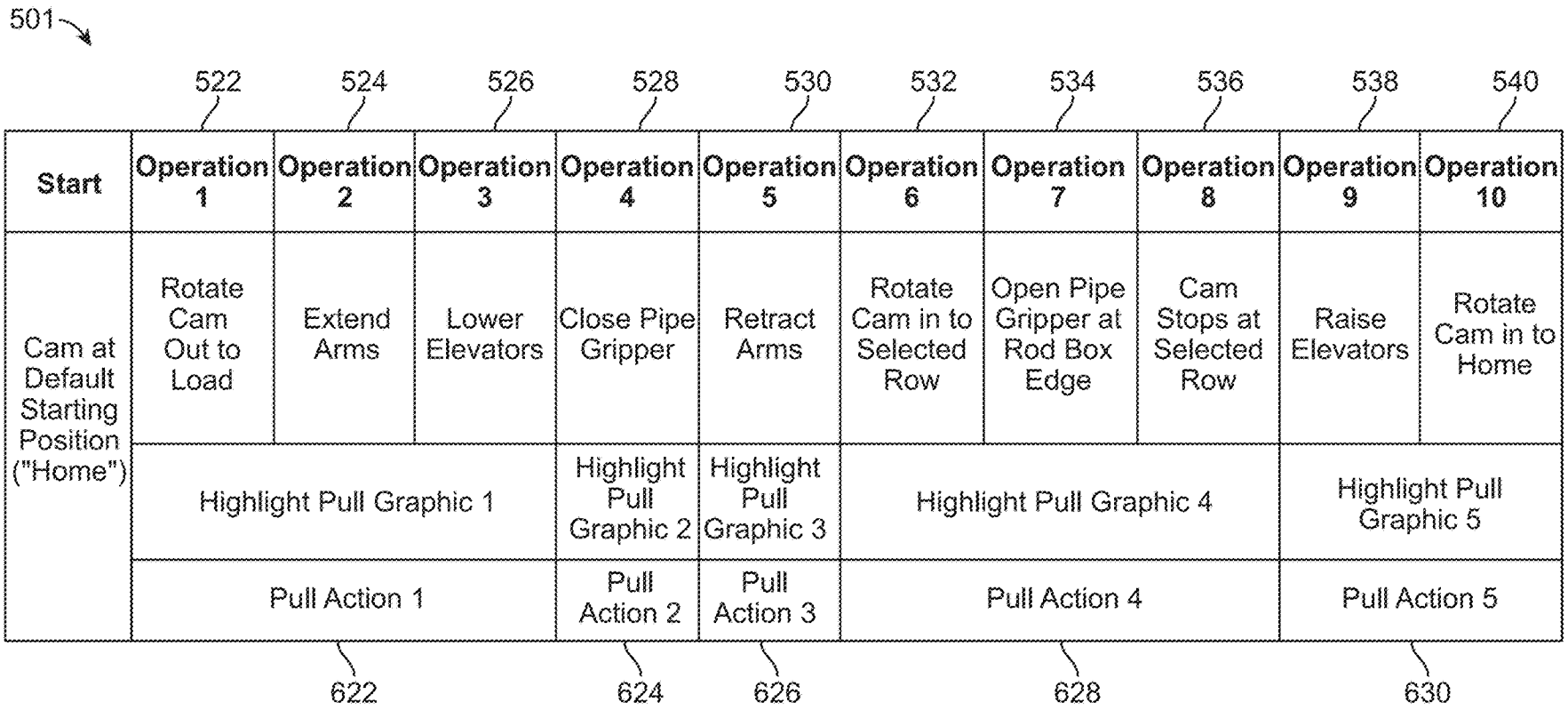
FIG. 7 is a table showing various processes used to transport a drill rod from the connection area to the rod box (pull sequence) in accordance with one embodiment of the disclosure.
Figure 8A:
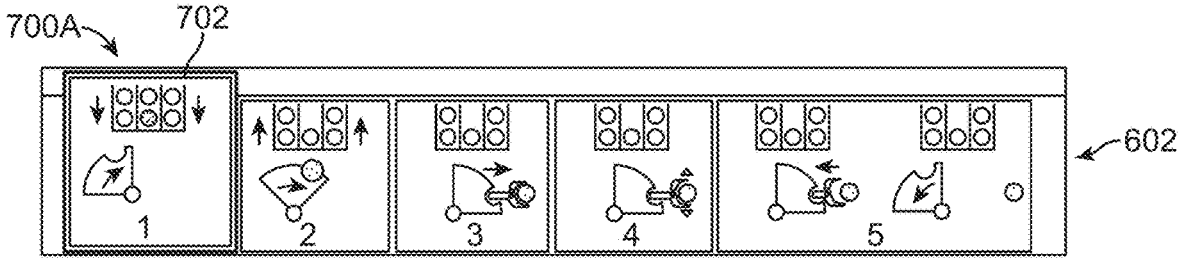
Figure 8B:
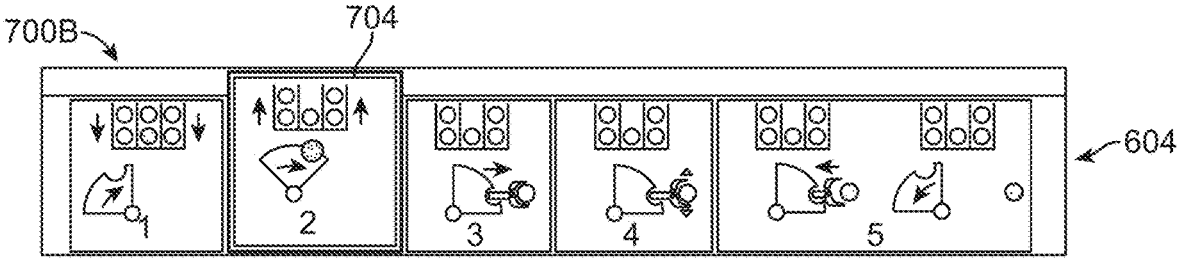
Figure 8C:
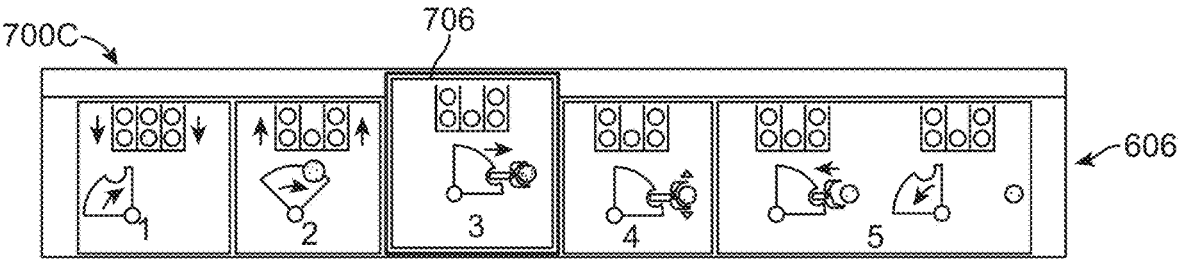
Figure 8D:
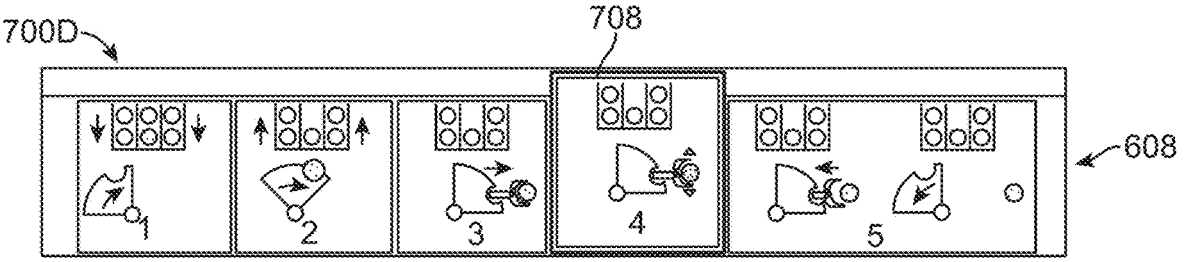
Figure 8E:
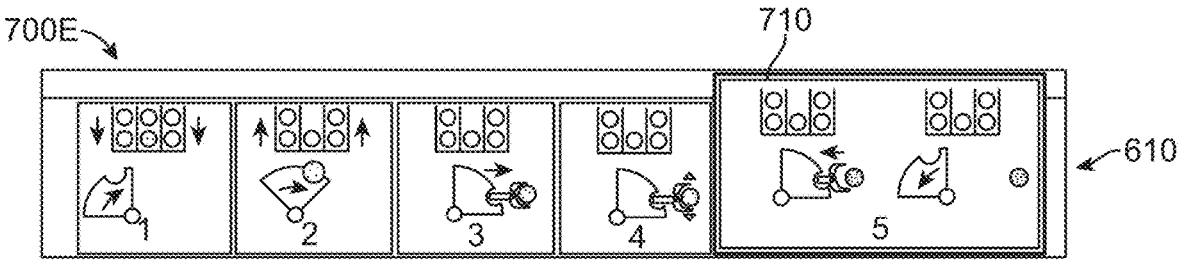
Figure 9A:
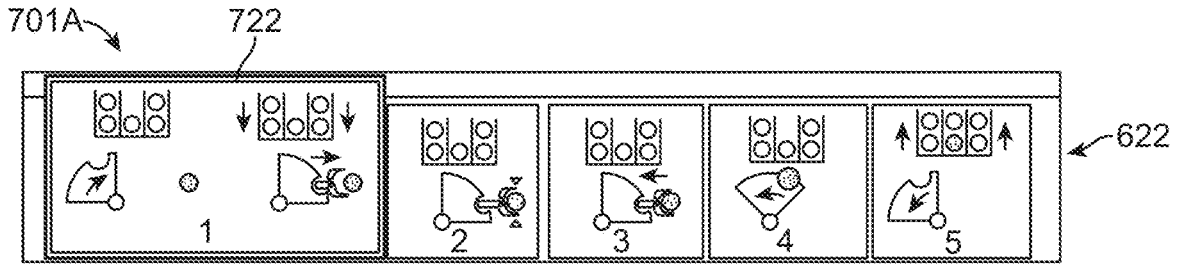
Figure 9B:
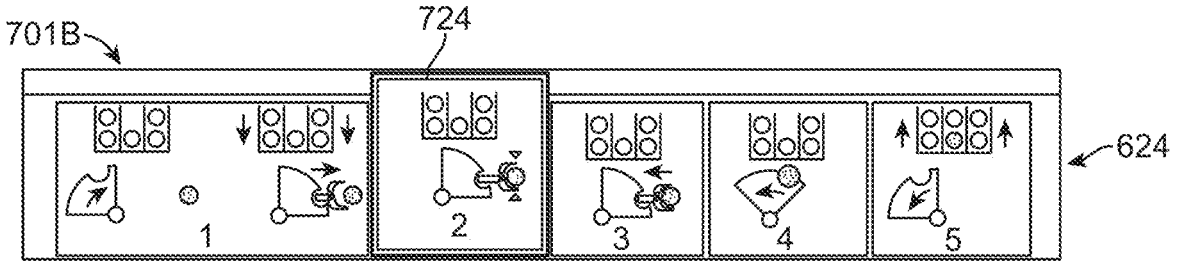
Figure 9C:
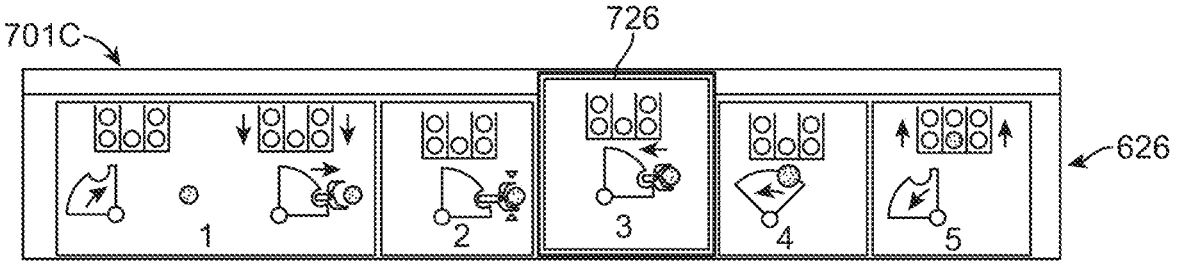
Figure 9D:
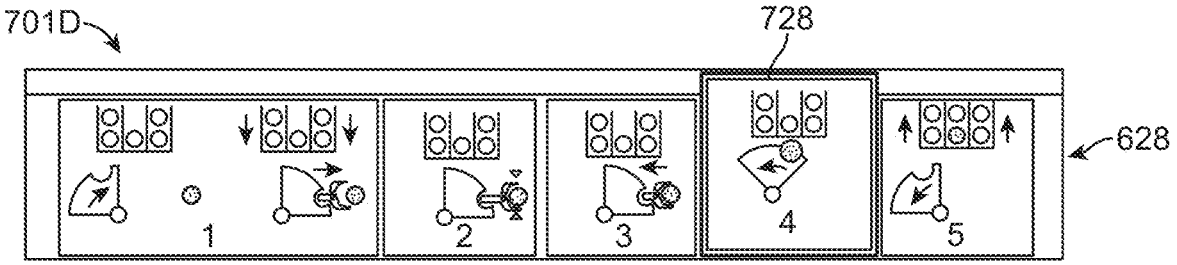
Figure 9E:
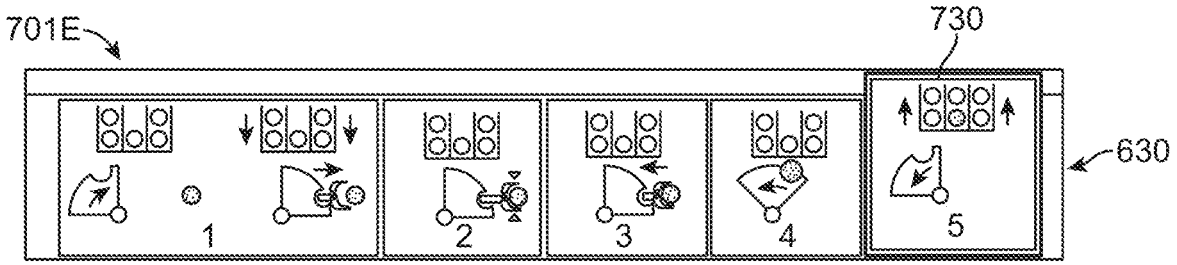

To more specifically illustrate exemplary operation of a drill in accordance with embodiments of the present disclosure, reference is now made to FIGS. 5A-J, which are enlarged perspective views of the horizontal directional drill 100 showing different physical states 400, 402, 404, 406, 408, 410, 412, 414, 416, 418 of the drill related to loading a drill rod in a push sequence. FIG. 6 is a table showing corresponding actions and corresponding physical operations that may occur during the exemplary push sequence illustrated in FIGS. 5A-5J. FIG. 7 is a table showing corresponding actions and corresponding physical operations that may occur during an exemplary pull sequence 501 (note that since the pull sequence of FIG. 7 is generally the opposite of the push sequence of FIG. 6, pull sequence figures are not separately provided). Finally, FIGS. 8A-E show example push graphics 700A-E that may be displayed on a screen of an operator output device, highlighting of the various actions during the push process, while FIGS. 9A-E show corresponding pull graphics 701A-E that may be displayed on a screen of an operator output device highlighting of the various actions during the pull process.

The push and pull sequences may have any number of physical operations. For example, as shown in FIG. 6, the push sequence for transporting a single drill rod 104 from the rod box 102 to the connection area 110 (see FIG. 1) includes nine physical operations. Similarly, the exemplary pull sequence of FIG. 9 for moving a single drill rod 104 from the connection area 110 to the rod box 102 may include ten physical operations. During some of the physical operations controlled by the controller 118 (see Operation 7 in FIG. 6), the operator may be required to complete some other activities that are not considered part of the push and pull sequences for pipe transport (e.g., pipe thread lubrication and connection of the drill rod to the drill string). These other activities may utilize different inputs (other than the rocker switch) between some of the physical operations of the push and pull sequences. As these other activities (e.g., makeup, breakout, lubrication) are not addressed by the assisted modes of the present disclosure, no further description of these activities is provided herein.

As stated elsewhere herein, and as shown for example in FIG. 6, one or more actions may include two or more physical operations coordinated by the pipe transport apparatus 108. As a result, the various physical operations of each of the push and pull sequences may be grouped into a lesser number of actions as shown in the Tables of FIGS. 6 and 7. For example, in the push sequence of FIG. 6, the nine physical operations are grouped into five actions. Once again, other operations not assisted by the controller may be performed before, after, or between some of these physical operations (e.g., makeup, breakout, and lubrication, which may be other activities).

With reference now to FIGS. 5A-5J and FIG. 6, an exemplary push sequence will now be described. In drill state 400 shown in FIG. 5A, the pipe transport apparatus 108 of the horizontal directional drill 100 begins with the cams 130 in a starting or home position and the drive system 112 disconnected from the drill string (not shown) and retracted, i.e., ready to receive another drill rod 104 from the rod box 102 to the connection area 110.

From this state, the operator may toggle the control system to initiate the push sequence. The operator may then select a row of the rod box 102 from which to select a drill rod 104. For example, the operator may use button switches adjacent to the display screen (see FIG. 1) to toggle and to select the desired row. The selected row may then be displayed on the same display screen. The cam pockets 132 may or may not be aligned to the drill rod 104 in the selected row in the home position.

The operator may then provide an operator input (e.g., press and hold down a rocker switch in a forward position) to execute a first action 602 in the push sequence 500. In response, a first physical operation 502 may be performed in which the cams 130 rotate to a position corresponding to the pre-selected row in state 402 as shown in FIG. 5B (note that only one drill rod 104 is shown in the rod box in FIGS. 5A-5J). A first push graphic 702 (see FIG. 8A) may be highlighted in the push graphic 700A corresponding to the first action 602. The other graphics (704, 706, 708, 710) may be visible but not highlighted at this time.

If the operator continues to press and hold down the rocker switch, a second physical operation 504 may be performed in which the elevators 134 lower. The lowering of the elevators 134 may place the pre-selected drill rod 104 into the cam pockets 132 in state 404 as shown in FIG. 5C. Completing the second physical operation 504 may complete first action 602. The pipe transport apparatus 108 may pause after completing the first action 602 even if the operator continues to engage the rocker switch.

In some embodiments, if the operator releases the rocker switch at any point before the first action 602 (or any of the other actions described herein with respect to FIGS. 6 and 7), is completed, the current operation of the pipe transport apparatus 108 may stop. Moreover, if the rocker switch is moved to a reverse position opposite the forward position, the pipe transport apparatus 108 may reverse the current action, which may undo the current operation or the entire current action. Releasing the rocker switch may again stop the reverse action. Reengaging the rocker switch in the reverse position may continue to undo the previous operation or the entire previous action.

Once action 602 is complete, the operator may release the rocker switch, and then may again press and hold the rocker switch to initiate and execute second action 604 in the push sequence 500. In response, a third physical operation 506 may be performed in which the cams 130 rotate out toward the connection area 110 to position the drill rod 104 in state 406 as shown in FIG. 5D. A second push graphic 704 may be highlighted in the push graphic 700B (see FIG. 8B) corresponding to the second action 604. The other graphics (702, 706, 708, 710) may be visible at this time but not highlighted.

While the operator continues to press and hold down the rocker switch, a fourth physical operation 508 may be performed in which the pipe grippers 136 associated with the cams 130 may close as the cams rotates past the edge of the rod box 102. The cams 130 may continue to rotate until reaching a pipe loading position in state 408 as shown in FIG. 5E.

Figure 5F:
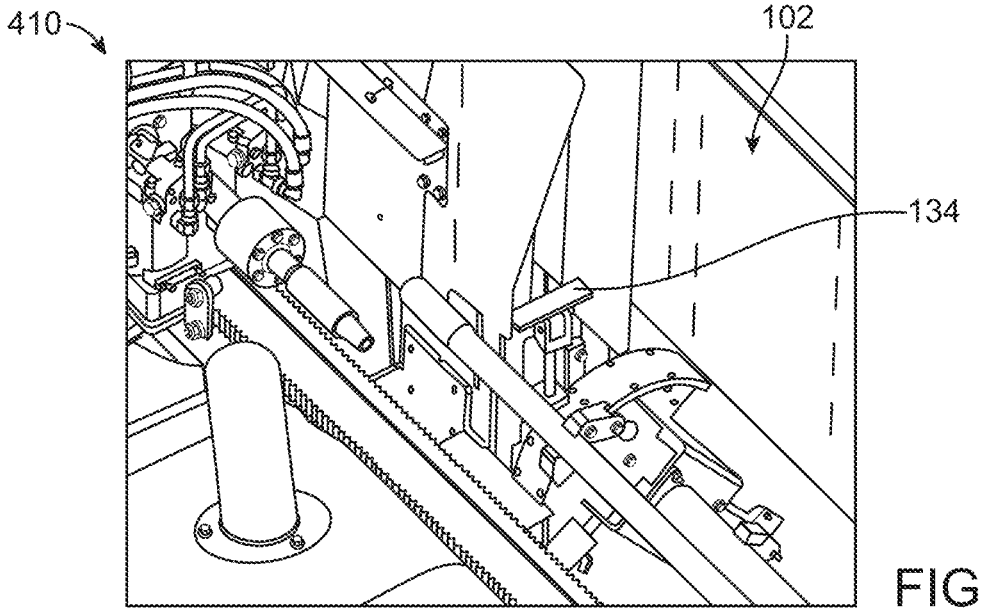

While the operator continues to press and hold down the rocker switch, a fifth physical operation 510 may be performed in which the elevator 134 rises to a raised position in state 410 as shown in FIG. 5F to retain any remaining drill rods in the rod box 102. The pipe transport apparatus 108 may then pause again as action 604 is complete.

Figure 5G:
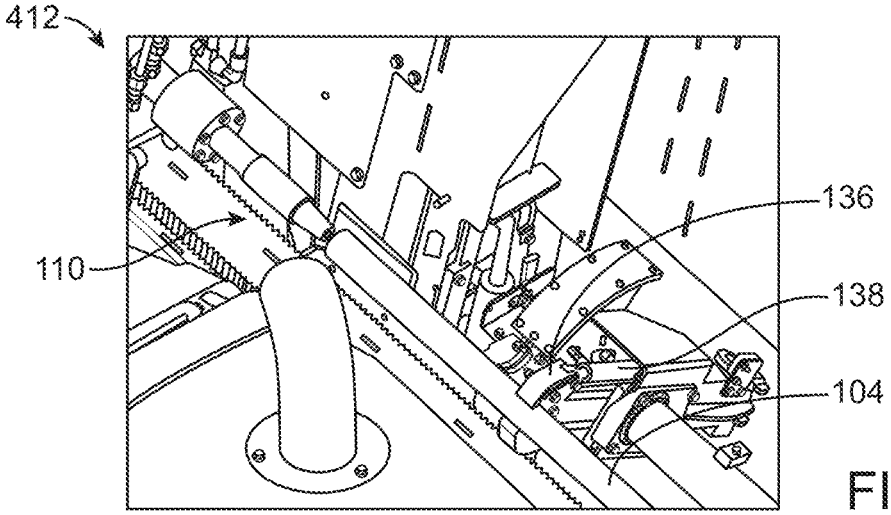

The operator may then release the rocker switch, and then again press and hold the rocker switch to execute third action 606 in the push sequence 500. In response, a sixth physical operation 512 may be performed in which the arms 138 extend and position the drill rod 104 in the connection area 110 with the drill rod held by the pipe grippers 136 in state 412 as shown in FIG. 5G. A third push graphic 706 may be highlighted in the push graphic 700C (see FIG. 8C) corresponding to the third action 606. The other graphics (702, 704, 708, 710) may be visible but not highlighted at this time. Once the arms 138 are extended, the pipe transport apparatus 108 may again pause as action 606 is complete.

Figure 5H:
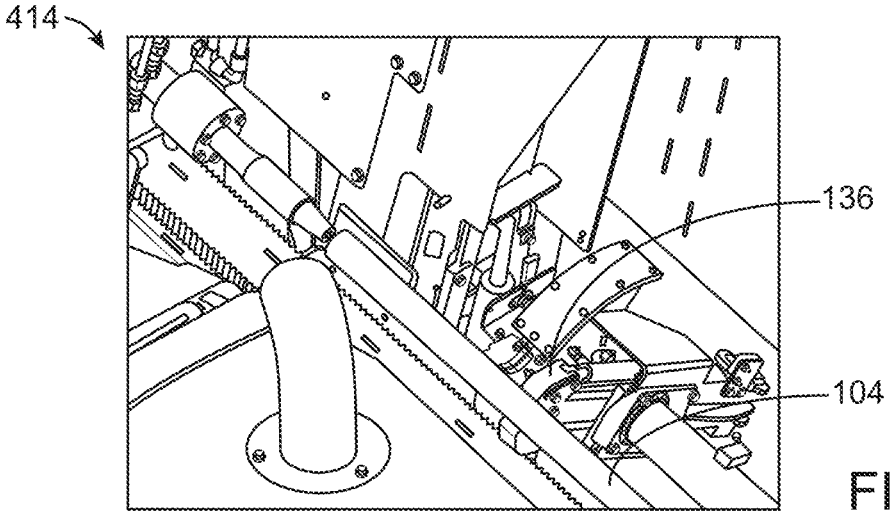

The operator may again release the rocker switch, and then, the operator may execute a fourth action 608 in the push sequence 500. In some embodiments, the operator may press and hold a button switch that is different than the rocker switch to execute the fourth action 608 (e.g., another button switch on the joystick). In response, the seventh physical operation 514 may be performed in which the pipe grippers 136 are opened to state 414 as shown in FIG. 5H to release the drill rod 104. At this time, the operator may perform other activities in a "makeup" process to attach the drill rod 104 to the drill string. The pipe transport apparatus 108 may not be allowed by the control system to continue operation until the pipe grippers 136 are opened. A fourth push graphic 708 may be highlighted in the push graphic 700D (see FIG. 8D) corresponding to the fourth action 608. The other graphics (702, 704, 706, 710) may be visible but not highlighted at this time. Once the pipe grippers 136 are open, the pipe transport apparatus 108 may again pause as action 608 is complete.

Figure 5I:
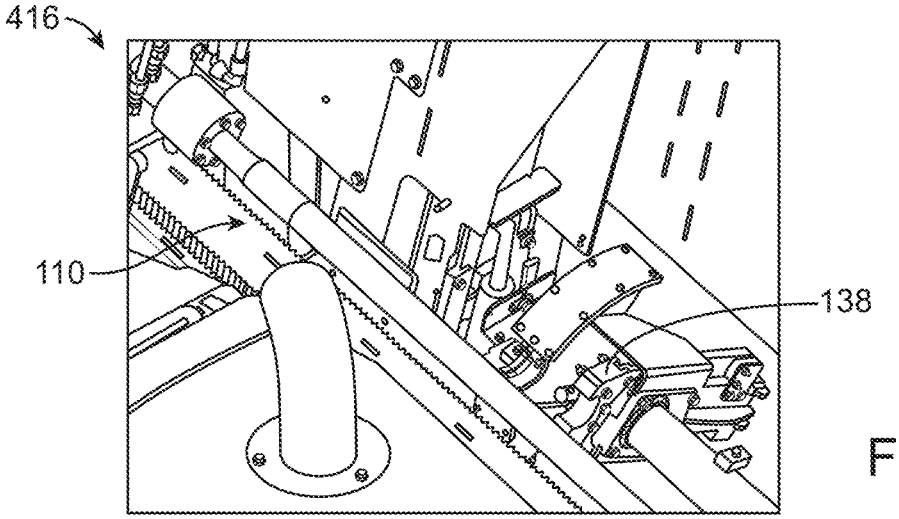

Once makeup is complete and the pipe grippers 136 are opened, the operator may again press and hold the rocker switch to execute fifth action 610 in the push sequence 500. In response, an eighth physical operation 516 may be performed in which the arms 138 retract away from the connection area 110 in state 416 as shown in FIG. 5I. A fifth push graphic 710 may be highlighted in the push graphic 700E (see FIG. 8E) corresponding to the fifth action 610. The other graphics (702, 704, 706, 708) may be visible but not highlighted at this time.

Figure 5J:
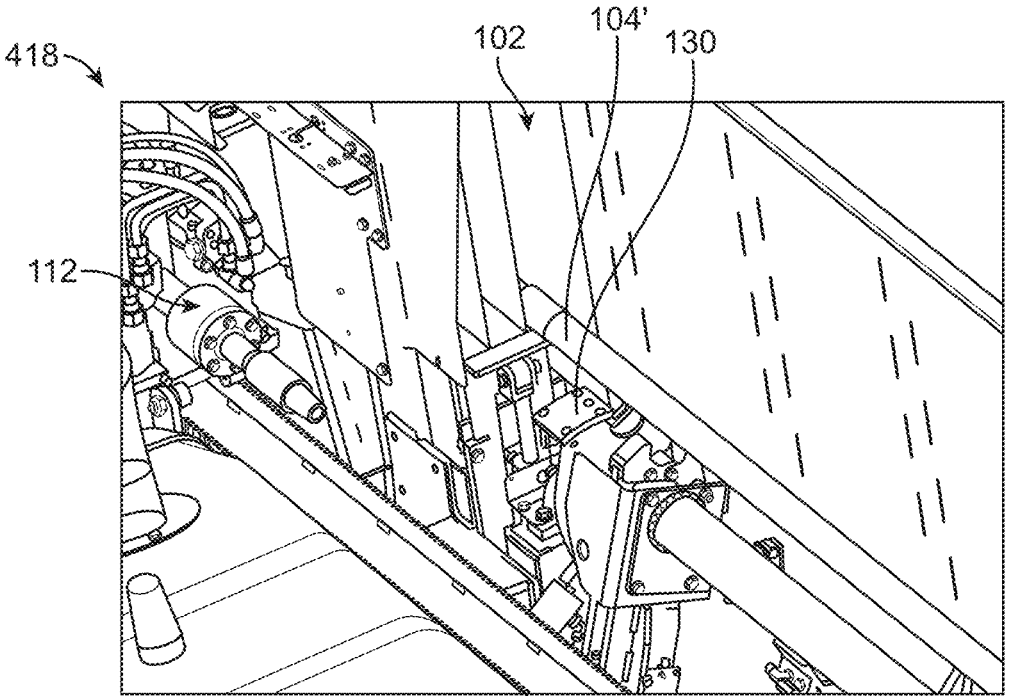

While the operator continues to press and hold down the rocker switch, a ninth physical operation 518 may be performed in which the cams 130 rotate back to the home position in state 418 as shown in FIG. 5J. After the drill is again advanced and the drive system 112 disconnected and retracted, another drill rod 104' may be loaded from the same selected row of the rod box 102 unless or until another row is selected by the operator.

Actions may also be executed in a pull sequence 501, which is, generally, the push sequence 500 in a reverse order. In the pull sequence, the cams 130 may reside in the default or home position (similar to state 418 as shown in FIG. 5J). If needed, the operator may toggle to the pull sequence. The operator may select a row of the rod box 102 in which the drill rod 104 is to be placed.

The operator can provide an operator input (e.g., press and hold down a rocker switch in a forward position) to execute a first action 622 in the pull sequence 501. In response, a first physical operation 522 may be performed in which the cams rotate out toward the connection area 110 in (similar to state 416 as shown in FIG. SI). A first pull graphic 722 may be highlighted in the pull graphic 701A (see FIG. 9A) to associate with the first action 622. The other graphics (724, 726, 728, 730) may be visible but not highlighted at this time. The pipe grippers 136 may already be open. Otherwise, the pipe grippers 136 may open as the cams 130 rotate past the rod box 102.

While the operator continues to press and hold down the rocker switch, a second physical operation 524 may be performed in which the arms 138 are extended toward the drill rod 104 in the connection area 110 (similar to state 414 as shown in FIG. 5H).

While the operator continues to press and hold down the rocker switch, a third physical operation 526 may be performed in which the elevators 134 are lowered. Once the elevators 134 are lowered, the pipe transport apparatus 108 may pause as action 622 is complete.

The operator may release the rocker switch, and then, the operator may execute a second action 624 in the pull sequence 501. In some embodiments, the operator may press and hold a button switch that is different than the rocker switch to execute the second action 624 (e.g., another button switch on the joystick, which may be different than the button switch used in action 608). In response, the fourth physical action 528 may be performed in which the pipe grippers 136 are closed (similar to state 412 as shown in FIG. 5G but with the elevator lowered). The operator may also perform other activities in a "breakout" process to remove the drill rod 104 from the drill string 106. The pipe transport apparatus 108 may not be allowed by the control system to continue operation until the pipe grippers 136 are closed. A second pull graphic 724 may be highlighted in the pull graphic 701B (see FIG. 9B) to associate with the second action 624. The other graphics (722, 726, 728, 730) may be visible but not highlighted at this time. Once the pipe grippers 136 are closed, the pipe transport apparatus 108 may pause as action 624 is complete.

Once breakout is complete and the pipe grippers 136 are closed, the operator may again press and hold the rocker switch to execute third action 626 in the pull sequence 501. In response, a fifth physical operation 530 may be performed in which the arms 138 are retracted from the connection area 110. A third pull graphic 726 may be highlighted in the pull graphic 701C (see FIG. 9C) corresponding to the third action 626. The other graphics (722, 724, 728, 730) may be visible but not highlighted at this time. Once the arms 138 are retracted, the pipe transport apparatus 108 may pause as action 626 is complete.

The operator may release the rocker switch, and then, the operator may again press and hold the rocker switch to execute fourth action 628 in pull sequence 501. In response, a sixth physical operation 532 may be performed in which the cams 130 rotate to the selected row of the rod box 102. A fourth pull graphic 728 may be highlighted in the pull graphic 701D (see FIG. 9D) corresponding to the fourth action 628. The other graphics (722, 724, 726, and 730) may be visible but not highlighted at this time.

While the operator continues to press and hold down the rocker switch, a seventh physical operation 534 may be performed in which the pipe grippers 136 are opened as the cams 130 rotate past an edge of the rod box 102.

While the operator continues to press and hold down the rocker switch, an eighth physical operation 536 may be performed in which the cams 130 rotate to and stop at the selected row (similar to state 404 as shown in FIG. 5C). Once the cams 130 stop at the selected row, the pipe transport apparatus 108 may pause as action 628 is complete.

The operator may release the rocker switch, and then, the operator may again press and hold the rocker switch to execute fifth action 630 in pull sequence 501. In response, a ninth physical operation 538 may be performed in which the elevators 134 are raised to place the drill rod 104 into the selected row of the rod box 102 (similar to state 402 as shown in FIG. 5B). A fifth pull graphic 730 may be highlighted in the pull graphic 701E to associate with the fifth action 630. The other graphics (722, 724, 726, 728) may be visible but not highlighted at this time.

While the operator continues to press and hold down the rocker switch, a tenth physical operation 540 may be performed in which the cams 130 rotate to the home position (similar to state 400 as shown in FIG. 5A). Once the cams 130 return to the home position, the pipe transport apparatus 108 may pause as action 630 is complete.

Figure 10:
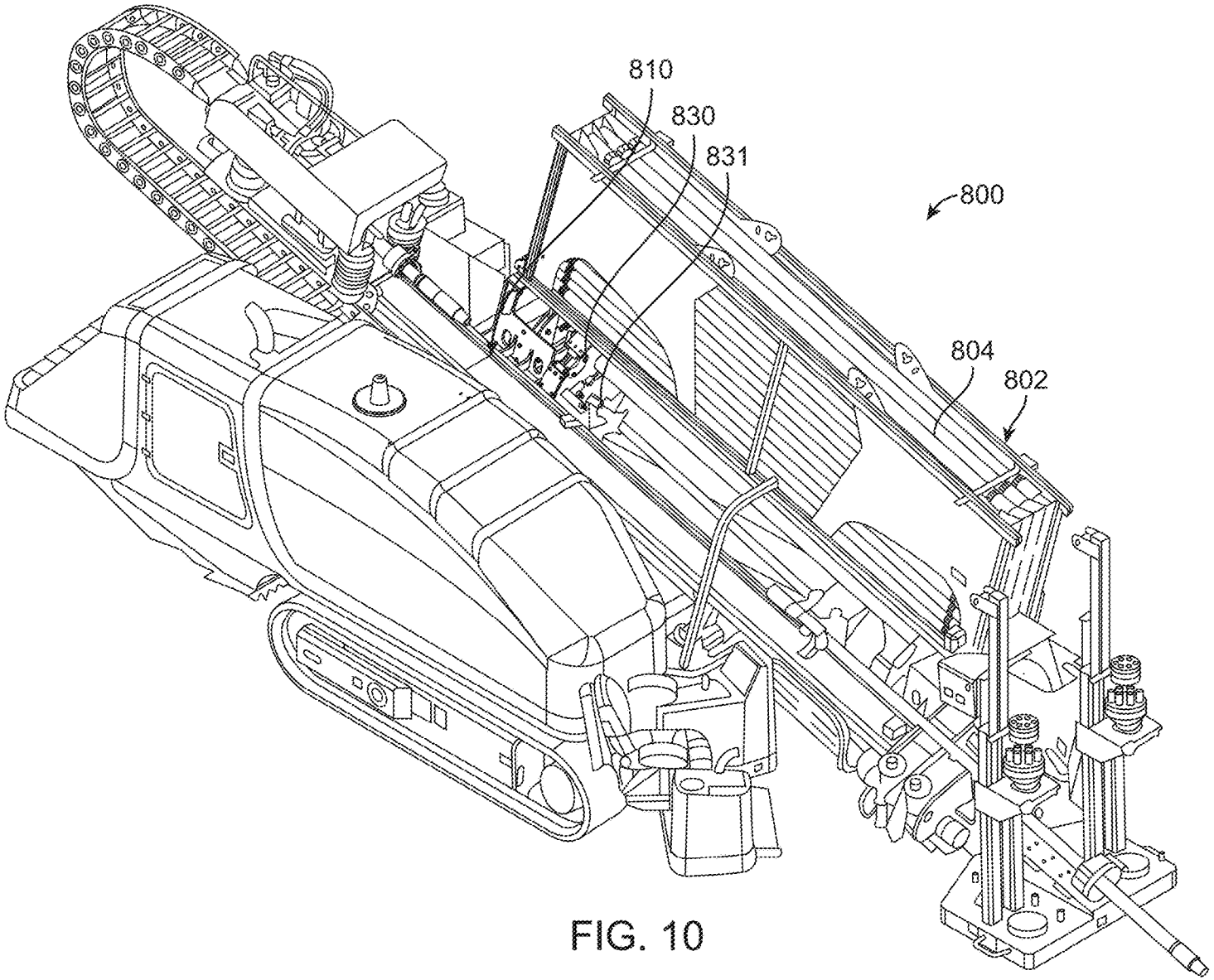
FIG. 10 is a perspective view of a different horizontal directional drill incorporating an assisted mode in accordance with another embodiment of the present disclosure, the drill including a connection area and a rod box.
Figure 11A:
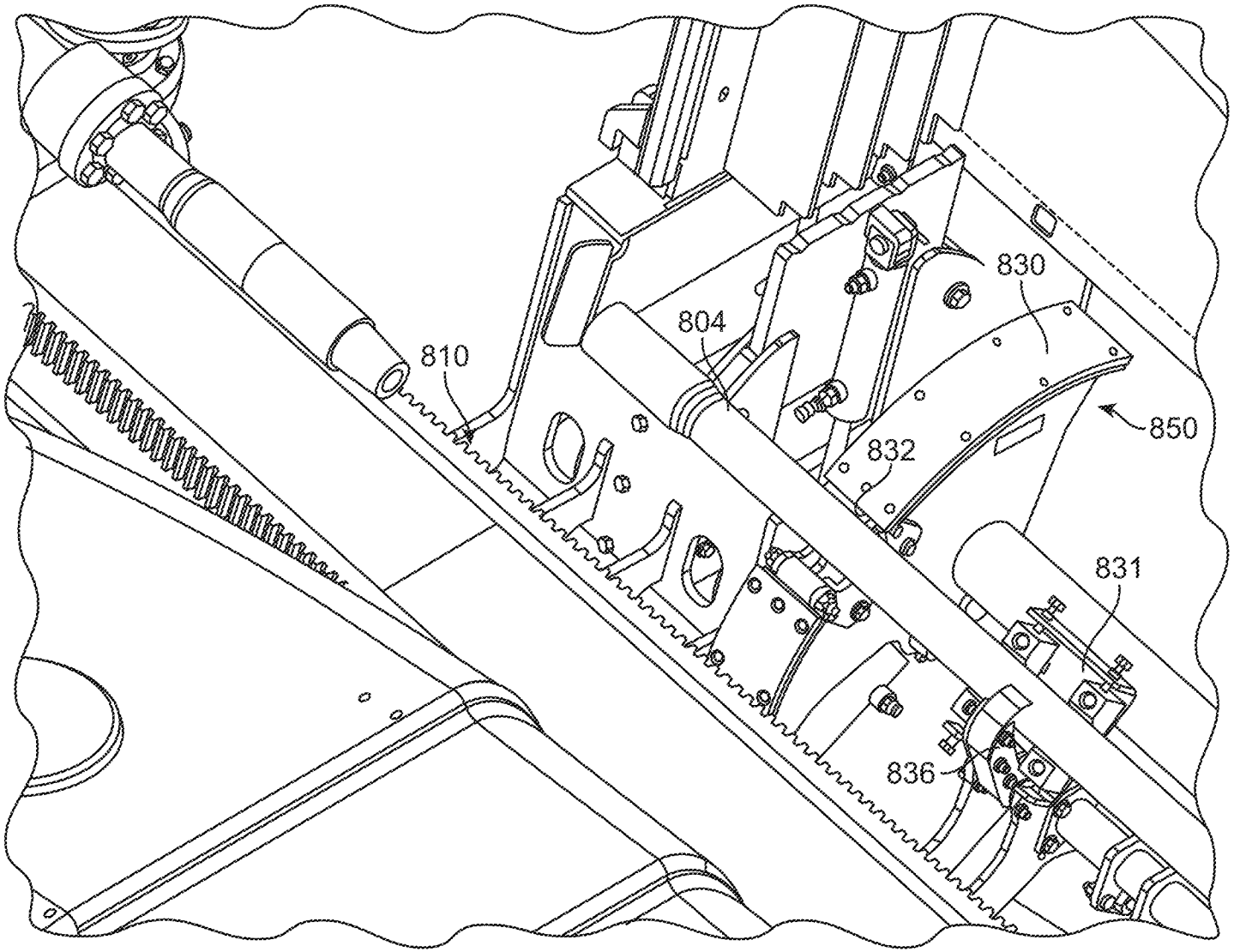
Figure 11B:
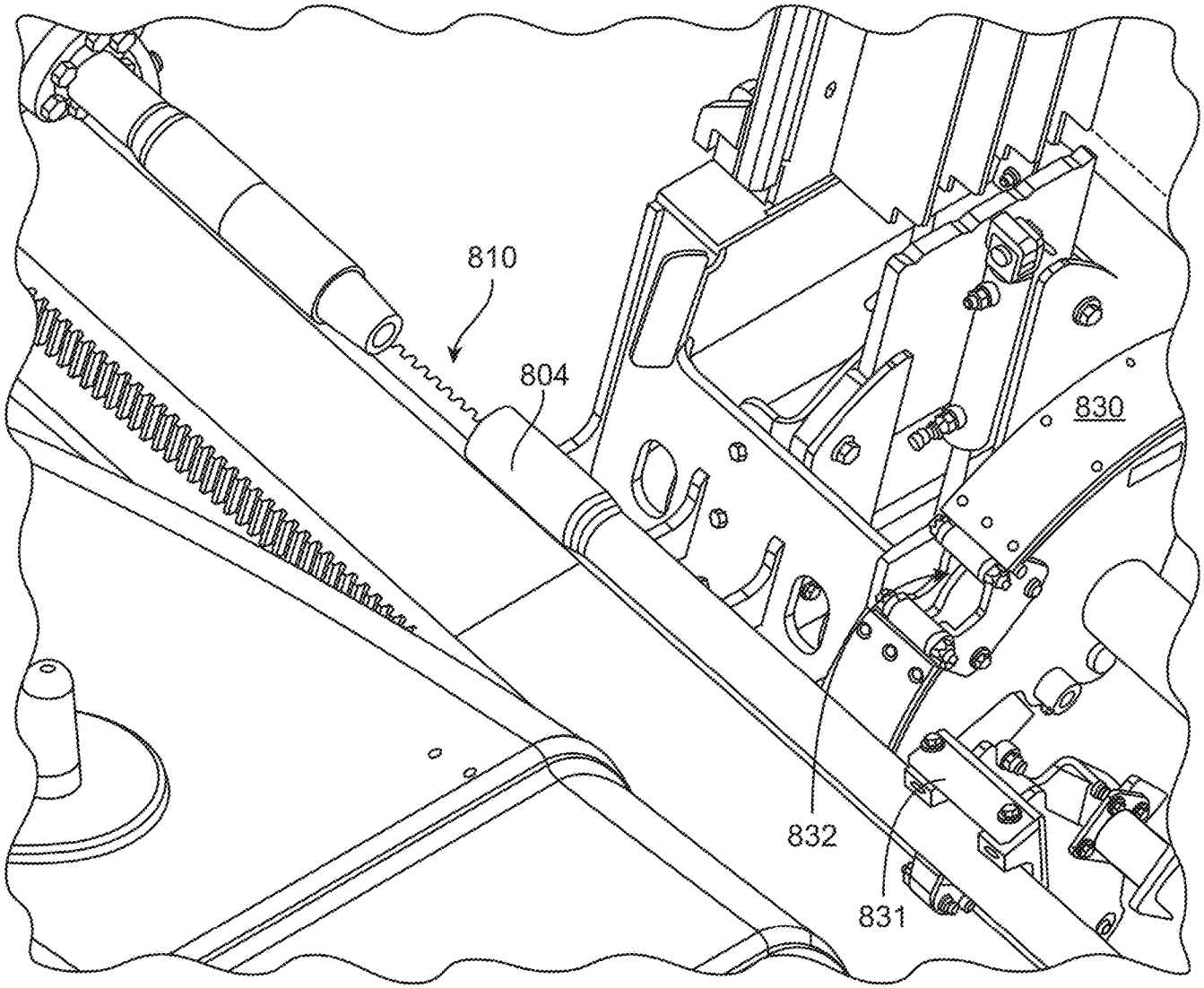

FIGS. 10, 11A, and 11B are views of a horizontal directional drill 800. FIG. 10 in accordance with another embodiment of the disclosure. The drill 800 is similar in many respects to the drill 100 described and illustrated herein. However, instead of using the single cam to transport rod sections like the drill 100, the drill 800 uses two cams to transport rod sections. Further, drill 800 is larger than drill 100. FIG. 11A shows a drill rod 804 rotated by a first cam 830 to a grip point where it may be gripped by a second cam 831 (e.g., a load arm that rotates to move the drill rod). FIG. 11B shows the drill rod 804 rotated to a connection area 810 by a second cam 831. Many of the parts and components depicted in FIGS. 10, 11A, and 11B are the same or similar to those depicted in, and described with regard to, FIGS. 1A-5J. Reference is made to the discussion above regarding FIGS. 1A-5J for numbered elements depicted in, but not specifically discussed with regard to, FIGS. 10, 11A, and 11B.

The position of the drill rod 804 in FIG. 11A may be compared to FIG. 5E, which shows the pipe gripper 136 closed on the drill rod 104. The position of the drill rod 804 in FIG. 11B may be compared to the position of the drill rod 104 in FIG. 5G, which shows the drill rod positioned in the connection area 110.

These components may be adapted for use in the larger drill 800, and the larger drill 800 may include two cams. The first cam 830 may be the same or similar to cam 130 in many aspects, and uses a rotary motion to move the drill rod 804 away from the rod box 802. Instead of rotating fully to the connection area 810, the first cam 830 moves the drill rod 804 to a grip point 850 (see FIG. 11A) so that the second cam 831 can receive the drill rod.

The second cam 831 may also be described as a load arm configured to rotate between at least between the grip point 850 (see FIG. 11A) and the connection area 810 (see FIG. 11B), which moves the drill rod 804 between the cam pocket 832 and connection area 810 in a rotary motion. Perhaps best seen in FIG. 11A, the second cam 831 includes a pipe gripper 836 to clamp and secure the drill rod 804, similar to pipe gripper 136 (FIG. 2). In contrast to some embodiments of arm 138 (FIG. 2), which may remain aligned to the cam pocket 132 (FIG. 5A), the second cam 831 does not move with the first cam 830 and may not always be aligned to the cam pocket 832. In other words, first cam 830 "passes" or "hands off" the drill rod 804 to second cam 831, which rotates about a different axis to move the drill rod 804 into the connection area 810 using a rotary motion.

Figure 12:
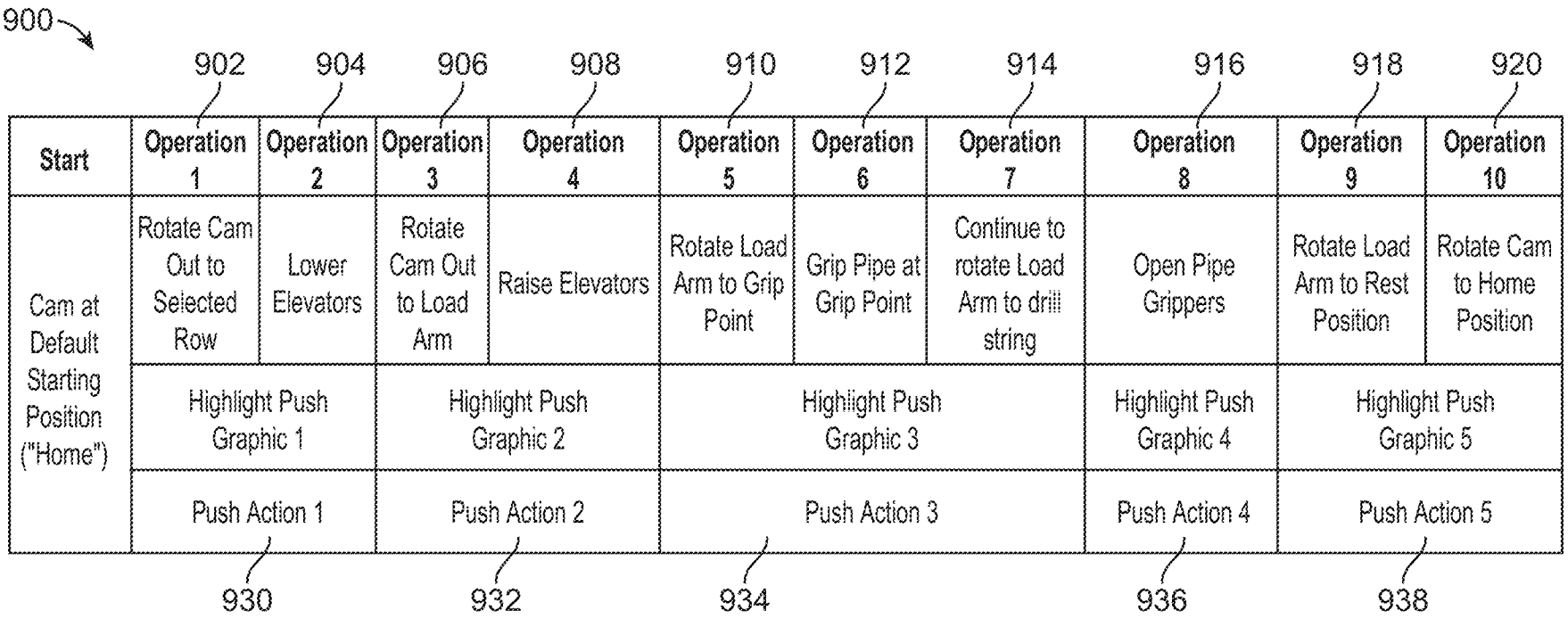
FIG. 12 is a table showing various processes used to transport a drill rod, using the drill of FIG. 10, from the rod box to the connection area (push sequence) in accordance with one embodiment of the disclosure.

FIG. 12 is a table showing actions and physical operations that may occur during an exemplary push sequence 900 that may be used with horizontal directional drill 800 (FIG. 10). Many of the operations and actions depicted in FIG. 12 are the same or similar to those depicted in, and described with regard to, FIG. 6. Reference is made to the discussion above regarding FIG. 6 for discussion of elements depicted in, but not specifically discussed with regard to, FIG. 12.

The operator may provide an operator input to execute any of the actions 930, 932, 934, 936, 938 in the push sequence 900. The operator input may be a forward operator input, such as engaging a rocker switch into a forward position while the mode selected is the push sequence 900. The pipe transport apparatus of the drill may pause after completing any of the actions 930, 932, 934, 936, 938 even if the operator continues to engage the rocker switch. After completion of an action 930, 932, 934, 936, 938, if the operator releases and reengages the rocker switch into a forward position associated with the forward operator input, the subsequent action may be initiated and executed.

First action 930 may be similar to first action 602 (FIG. 6). The first action 930 may include physical operations 902, 904, which may be initiated in sequence as the operator continues to engage the rocker switch. Physical operations 902, 904 may be similar to physical operations 502, 504 (FIG. 6), respectively, except that physical operation 902 specifically rotates the first of two cams.

Second action 932 may be similar to second action 604 (FIG. 6). The second action 932 may include physical operations 906, 908, which may be initiated in sequence as the operator continues to engage the rocker switch. Physical operation 906 may be similar to physical operation 506 (FIG. 6) in that the drill rod is rotated out toward the connection area. Physical operation 906 may differ from physical operation 506 in that the drill rod is moved to the second cam (e.g., load arm), which is only part way to the connection area. Physical operation 908 may be similar to physical operation 510 (FIG. 6) in that the elevator rises.

Third action 934 may be similar to third action 606 (FIG. 6). The third action 934 may include physical operations 910, 912, 914, which may be initiated in sequence as the operator continues to engage the rocker switch. Physical operation 910 rotates the second cam (e.g., load arm) toward the grip point to receive the drill rod from the first cam. Physical operation 912 may be similar to physical operation 508 (FIG. 6) in that the pipe gripper closes onto the drill rod, except the pipe gripper in physical operation 912 is associated with the second cam (e.g., load arm). Physical operation 914 continues to rotate the second cam (e.g., load arm) to the drill string in the connection area for drill string attachment.

Fourth action 936 may be similar to fourth action 608 (FIG. 6). The fourth action 936 may include physical operation 916. Physical operation 916 may be similar to physical operation 514 (FIG. 6) in that the pipe gripper is opened, except that the pipe gripper in physical operation 916 is associated with the second cam (e.g., load arm).

Fifth action 938 may be similar to fifth action 610 (FIG. 6). The fifth action 938 may include physical operations 918, 920. Physical operation 918 may be similar to physical operation 516 (FIG. 6) in that the arm moves away from the connection area. In physical operation 918, the second cam (e.g., load arm) is rotated to a rest position away from the connection area whereas, in physical operation 516, the arm is retracted away from the connection area. Physical operation 920 may be similar to physical operation 518 (FIG. 6), except that physical operation 920 specifically rotates the first cam to a home position.

Figure 13:
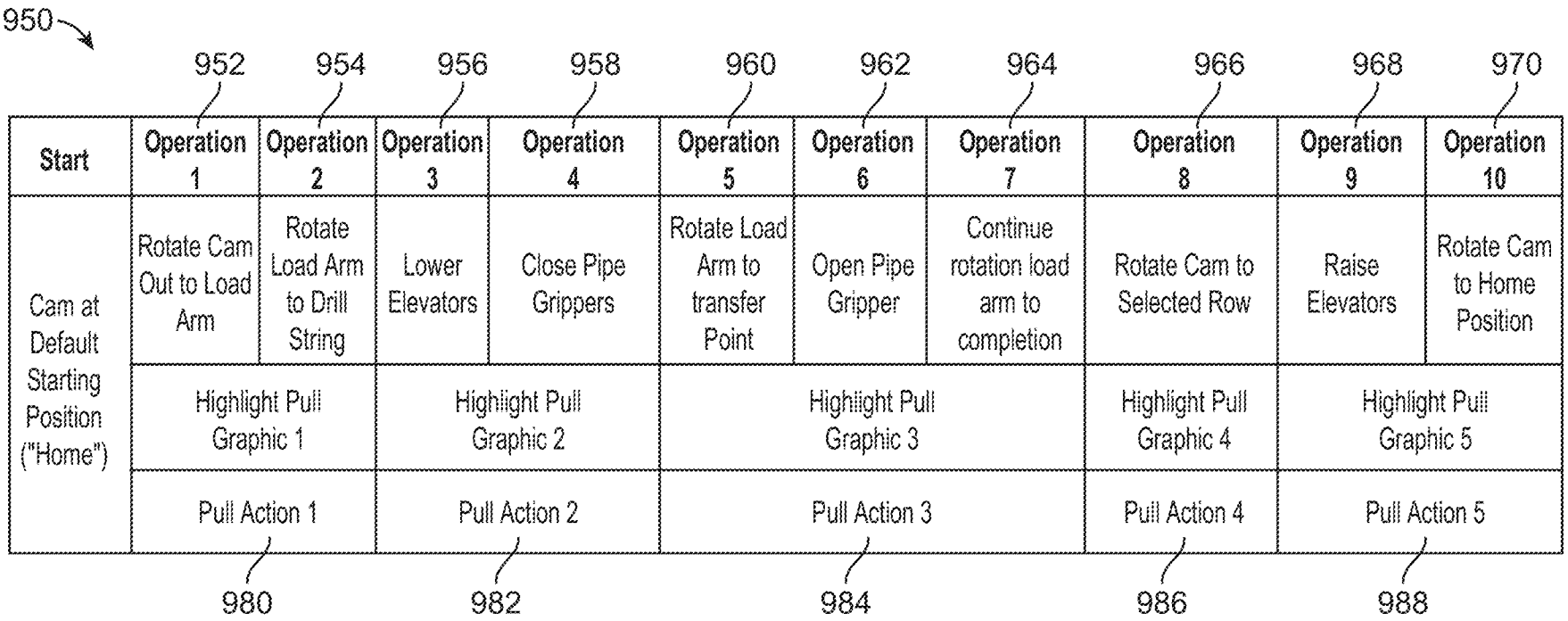
FIG. 13 is a table showing various processes used to transport a drill rod, using the drill of FIG. 10, from the connection area to the rod box (pull sequence) in accordance with one embodiment of the disclosure.

FIG. 13 is a table showing actions and physical operations that may occur during an exemplary pull sequence 950 that may be used with horizontal directional drill 800 (FIG. 10). Many of the operations and actions depicted in FIG. 13 are the same or similar to those depicted in, and described with regard to, FIG. 7. Reference is made to the discussion above regarding FIG. 7 for discussion of elements depicted in, but not specifically discussed with regard to, FIG. 13. The pull sequence 950 of FIG. 13 is generally the opposite of the push sequence 900 of FIG. 12.

The operator may provide an operator input to execute any of the actions 980, 982, 984, 986, 988 in the pull sequence 950. The operator input may be a forward operator input, such as engaging a rocker switch into a forward position while the mode selected is the pull sequence 950. The pipe transport apparatus of the drill may pause after completing any of the actions 980, 982, 984, 986, 988 even if the operator continues to engage the rocker switch. After completion of an action 980, 982, 984, 986, 988, if the operator releases and reengages the rocker switch into a forward position, the subsequent action may be initiated and executed.

First action 980 may be similar to first action 622 (FIG. 7). The first action 980 may include physical operations 952, 954, 956, which may be initiated in sequence as the operator continues to engage the rocker switch. Physical operations 952, 954, 956 may be similar to physical operations 522, 524, 526 (FIG. 7), respectively, except that physical operation 952 specifically rotates the first of two cams and physical operation 954 rotates the second cam (e.g., load arm) to the drill string in the connection area (e.g., instead of extending an arm out to the drill string).

Second action 982 may be similar to second action 624 (FIG. 7). The second action 982 may include physical operation 958. Physical operation 958 may be similar to physical operation 528 (FIG. 7), except the pipe gripper in physical operation 958 is associated with the second cam (e.g., load arm).

Third action 984 may be similar to third action 626 (FIG. 7). The third action 984 may include physical operations 960, 962, 964, which may be initiated in sequence as the operator continues to engage the rocker switch. In physical operation 960, the second cam (e.g., load arm) is rotated toward a transfer point. The transfer point may be the same position as the grip point (e.g., grip point 850 of FIG. 11A). Physical operations 962, 964 may be similar to physical operations 534, 536 (FIG. 7), respectively, except that physical operation 962 specifically opens the pipe gripper associated with the second cam (e.g., load arm) and physical operation 964 specifically rotates the second cam (e.g., load arm) to the transfer point for the drill rod to be received in the cam pocket of the first cam.

Fourth action 986 includes physical operation 966. In physical operation 966, the first cam rotates the drill rod to the selected row of the rod box.

Fifth action 988 may be similar to fifth action 630 (FIG. 7). The fifth action 988 may include physical operations 968, 970, which may be initiated in sequence as the operator continues to engage the rocker switch. Physical operations 968, 970 may be similar to physical operations 538, 540 (FIG. 7), respectively, except that physical operation 970 specifically rotates the first cam to a home position.

Figure 14:
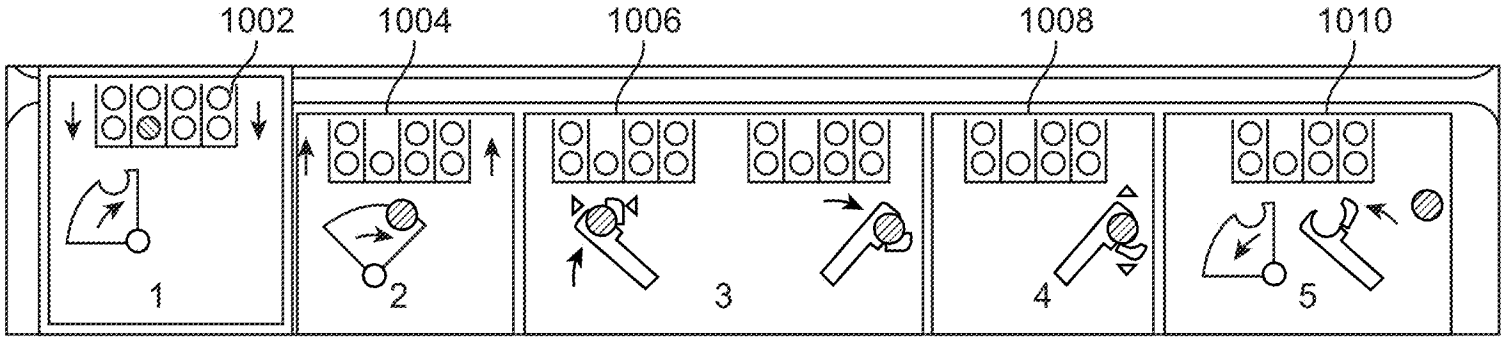
FIG. 14 illustrates exemplary graphics that may be displayed to the operator during transport of a drill rod from the rod box to the connection area (push sequence) using the drill of FIG. 10.
Figure 15:
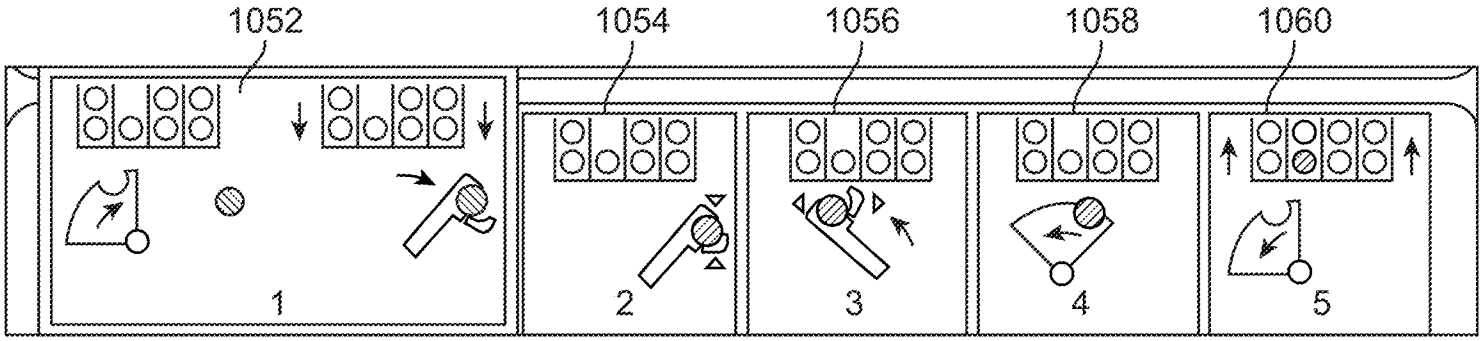
FIG. 15 illustrates exemplary graphics that may be displayed to the operator during transport of a drill rod from the connection area to the rod box (pull sequence) using the drill of FIG. 10.

FIG. 14 shows exemplary push graphics 1002, 1004, 1006, 1008, 1010, each of which is associated with a different push action 930, 932, 934, 936, 938 (FIG. 12), respectively, and shows icons mimicking the different associated actions. Similarly, FIG. 15 illustrates exemplary pull graphics 1052, 1054, 1056, 1058, 1060, each of which is associated with a different pull action 980, 982, 984, 986, 988 (FIG. 13), respectively, and shows icons mimicking the different associated actions.

All of the graphics associated with the push sequence or the pull sequence may be displayed to the operator concurrently to form one or more images. During the performance of each action, the associated graphic may be highlighted to the operator. As illustrated in FIG. 14, push graphic 1002 is highlighted during the execution of push action 930 (FIG. 12). As illustrated in FIG. 15, pull graphic 1052 is highlighted during the execution of pull action 980 (FIG. 13).

As one may appreciate, embodiments of the present disclosure may provide a horizontal directional drill that may be easily controlled and operated by a user using simple user inputs and indicators to move a drill rod between a rod box and a connection area with a plurality of physical operations. As a result, efficient operation of the horizontal directional drill, in terms of time and effort, may be facilitated despite the repetition of commands that may be required to operate the drill and despite interruptions that may occur during operation.

Illustrative embodiments are described and reference has been made to possible variations of the same. These and other variations, combinations, and modifications will be apparent to those skilled in the art, and it should be understood that the claims are not limited to the illustrative embodiments set forth herein.

What is claimed is:

1. A horizontal directional drill comprising:

a frame defining a connection area;

a drive system attached to the frame and adapted to rotate and axially advance a drill string comprised of two or more drill rods;

a rod box attached to the frame and adapted to hold a plurality of drill rods;

a pipe transport apparatus operable to move a drill rod from the rod box to the connection area by executing a plurality of physical operations; and a control system adapted to operate the pipe transport apparatus, wherein the control system commands the pipe transport apparatus to perform a plurality of actions to add the drill rod to the drill string or to remove the drill rod from the drill string, wherein at least one of the actions comprises two or more of the plurality of physical operations, the control system comprising:

an electronic controller operatively connected to the pipe transport apparatus; and an operator input device operatively connected to the controller and configured to generate a command to the controller in response to an operator input, wherein the operator input device comprises one or more switches associated with at least a forward operator input and a reverse operator input upon being engaged;

wherein the control system is adapted to execute each of the plurality of actions in response to receipt of the command and a detected state of the pipe transport apparatus, and wherein the pipe transport apparatus pauses upon completing each action of the plurality of actions until the command is again provided from the operator input device to the controller to perform a subsequent action of the plurality of actions, wherein the command is generated when the operator engages one of the switches.

2. The drill according to claim 1, wherein each of the plurality of actions are performed only while the one switch is engaged and held.

3. The drill according to claim 1, wherein holding the one switch causes the pipe transport apparatus to execute first and second operations of the plurality of physical operations and then pause.

4. The drill according to claim 3, wherein releasing the one switch before the second operation is complete causes the pipe transport apparatus to cease executing the first and second operations.

5. The drill according to claim 3, wherein engaging one of the switches associated with the reverse operator input before the second operation is complete causes the pipe transport apparatus to stop and reverse operation.

6. The drill according to claim 1, wherein the control system further comprises an output device operable to display a graphic corresponding to each of the plurality of actions.

7. The drill according to claim 6, wherein the output device is adapted to update the graphic after the pipe handling apparatus has completed each action and the one switch is released from the forward position.

8. A horizontal directional drill comprising:

a rod box adapted to hold a plurality of drill rods;

a frame attached to the rod box and defining a connection area to attach one of the plurality of drill rods to a drill string;

a pipe transport apparatus coupled to the frame and adapted to perform a plurality of physical operations to move a drill rod between the rod box and the connection area;

an electronic controller operatively coupled to the pipe transport apparatus and adapted to operate the pipe transport apparatus;

an operator input device operatively coupled to the controller and adapted to receive an operator input;

wherein the controller is further adapted to:

execute a plurality of actions to add the drill rod to the drill string or to remove the drill rod from the drill string, each action comprising one or more physical operations of the plurality of physical operations;

command the pipe transport apparatus to perform each of the physical operations encompassed by the current action in response to the operator input device receiving the operator input; and pause operation of the pipe transport apparatus upon completion of the current action before performing a subsequent action of the plurality of actions.

9. The drill according to claim 8, wherein the controller is further adapted to command the pipe transport apparatus to perform each of the one or more physical operations represented by the subsequent action in response to detecting disengagement and reengagement of the forward operator input.

10. The drill according to claim 8, wherein the operator input device comprises a rocker switch adapted to be manipulated between a neutral position, a forward position, and a reverse position, wherein the forward operator input is determined in response to an operator moving the rocker switch to the forward position, and wherein a reverse operator input is determined in response to the operator moving the rocker switch to the reverse position.

11. The drill according to claim 8, wherein the operator input device is further adapted to receive a toggle operator input, wherein the controller is further adapted to toggle the plurality of physical operations between physical operations corresponding to a push sequence to move one drill rod from the rod box to the connection area and physical operations corresponding to a pull sequence to move one drill rod from the connection area to the rod box.

12. The drill according to claim 11, wherein the operator input device comprises button switches adjacent to a display screen adapted to receive the toggle operator input.

13. The drill according to claim 8, further comprising an operator output device comprising a display screen operable to display graphics corresponding to the plurality of actions and an indication of the current action.

14. A method of operating a horizontal directional drill comprising:

receiving input at an operator input device for a pipe transport apparatus adapted to perform a plurality of physical operations in order to move a drill rod between a rod box and a connection area;

commanding the pipe transport apparatus to perform two or more of the plurality of physical operations in response to persistent engagement of the operator input device; and pausing operation of the pipe transport apparatus upon completing the two or more physical operations until the operator input is disengaged and reengaged.

15. The method according to claim 14, wherein the two or more physical operations comprise:

rotating a cam to a selected row of rods in the rod box; and lowering an elevator to load the rod from the row into a cam pocket associated with the cam.

16. The method according to claim 14, wherein the two or more physical operations comprises:

rotating a cam out to position the rod from a row of rods of the rod box toward the connection area;

gripping the rod with a pipe gripper as the cam rotates out; and raising an elevator of the assist system after the cam is rotated out.

17. The method according to claim 14, wherein the two or more physical operations comprises:

extending or rotating an arm coupled to a pipe gripper to position the rod in the connection area.

18. The method according to claim 14, wherein the two or more physical operations comprises:

opening a pipe gripper after the rod is positioned in the connection area.

19. The method according to claim 14, wherein the two or more physical operations comprises:

retracting or rotating an arm coupled to the pipe gripper from the connection area; and rotating a cam to a home position.

* * * * *